US010835801B1

(12) United States Patent
Hou

(10) Patent No.: US 10,835,801 B1
(45) Date of Patent: Nov. 17, 2020

(54) OPTIONALLY ADJUSTABLE SWING TRAINING APPARATUS WITH AUDIBLE AND/OR HAPTIC FEEDBACK

(71) Applicant: Best Swing One, LLC, Westlake Village, CA (US)

(72) Inventor: Wen-Sun Hou, Westlake Village, CA (US)

(73) Assignee: BEST SWING ONE, LLC, Westlake Village, CA (US)

( * ) Notice: Subject to any disclaimer, the term of this patent is extended or adjusted under 35 U.S.C. 154(b) by 0 days.

(21) Appl. No.: 16/595,325

(22) Filed: Oct. 7, 2019

(51) Int. Cl.
*A63B 69/36* (2006.01)

(52) U.S. Cl.
CPC ..... *A63B 69/3635* (2013.01)

(58) Field of Classification Search
USPC ..... 473/232–234, 226, 294, 296, 316, 324, 473/219, 239, 422, 297
See application file for complete search history.

(56) References Cited

U.S. PATENT DOCUMENTS 4,027,886 A * 6/1977 Katsube ..... A63B 69/3632 473/234
4,295,832 A * 10/1981 Karell ..... A63F 9/0098 273/456
5,360,209 A * 11/1994 Mollica ..... A63B 15/005 473/457
5,527,039 A * 6/1996 Levesque ..... A63B 69/3632 403/316
5,711,718 A * 1/1998 Mueller ..... A63B 15/005 473/234
5,776,006 A * 7/1998 Gruber ..... A63B 69/3638 473/256
6,955,610 B1 * 10/2005 Czaja ..... A63B 15/005 473/256
7,048,640 B2 * 5/2006 Light ..... A63B 69/3638 473/226
7,618,328 B2 * 11/2009 Davenport ..... A63B 15/005 473/257
7,798,910 B2 * 9/2010 Leadbetter ..... A63B 15/005 473/215
7,922,595 B2 * 4/2011 Libonati ..... A63B 15/005 473/224

(Continued)

*Primary Examiner* — Nini F Legesse
(74) *Attorney, Agent, or Firm* — Lyon & Harr, LLP; Richard T. Lyon

(57) ABSTRACT

A "Swing Trainer" provides a transverse slide mechanism that generates an audible and/or haptic click in response to a smoothness of a swing of a sports-related implement. In other words, the Swing Trainer clicks in a way that a user can either or both hear and/or feel during a swing of the sports-related implement. Such sports-related implements include, but are not limited to, golf clubs, tennis racquets, hockey sticks, baseball bats, lacrosse sticks, cricket bats, or any other sports-related implement wherein smoothness of a user swing is desirable. The Swing Trainer rotatably couples a proximal end to a distal end of the sports-related implement. Further, the Swing Trainer generates the audible and/or haptic click when a sliding force imparted to the Swing Trainer by the swing exceeds a static holding force of the transverse slide mechanism. Typically, the sliding force exceeds the static holding force during an improper user swing.

25 Claims, 13 Drawing Sheets

*Typical Prior Art Golf Club*

(56) References Cited

U.S. PATENT DOCUMENTS

| | | | | |
|---|---|---|---|---|
| 8,915,793 | B2 * | 12/2014 | Hou | A63B 69/3635 473/232 |
| 9,126,091 | B2 * | 9/2015 | Hou | A63B 60/00 |
| 2004/0018885 | A1 * | 1/2004 | Gulan | A63B 15/005 473/256 |
| 2012/0064986 | A1 * | 3/2012 | Brooks | G09B 19/0038 473/226 |

* cited by examiner

*Typical Prior Art Golf Club*

*Partial Perspective View of Exemplary Implementation of a Transverse Slide Mechanism of a Swing Trainer*

*Exemplary View of Swing Trainer Rotatably Coupled to Golf Club*

*Exemplary View of Swing Trainer Rotatably Coupled to Baseball Bat*

*Top View Showing a Proximal End of a Transverse Slide Mechanism Implementation*

*Bottom View Showing a Distal End of a Transverse Slide Mechanism Implementation*

*Top View Showing a Proximal End of an Activated Transverse Slide Mechanism Implementation*

*Bottom View Showing a Distal End of an Activated Transverse Slide Mechanism Implementation*

*Top View Showing a Proximal End of Another Transverse Slide Mechanism Implementation*

*Top View Showing a Proximal End of Another Activated Transverse Slide Mechanism Implementation*

*Partially Transparent Left Side View of Exemplary Implementation of the Transverse Slide Mechanism of the Swing Trainer*

*Partially Transparent Front Side View of Exemplary Implementation of the Transverse Slide Mechanism of the Swing Trainer*

*Left Side View of Striker Assembly of Exemplary Swing Trainer*

*Front Side View of Striker Assembly of Exemplary Swing Trainer*

*Partial Perspective View of Exemplary Implementation of the Transverse Slide Mechanism of the Swing Trainer*

*Top View Showing a Proximal End of a Transverse Slide Mechanism Implementation of a Swing Trainer Having a Curved Slider Assembly*

*Bottom View Showing a Distal End of a Transverse Slide Mechanism Implementation of a Swing Trainer Having a Curved Slider Assembly*

*Exemplary View of Swing Trainer with Angle Indicators Rotatably Coupled to Golf Club*

OPTIONALLY ADJUSTABLE SWING TRAINING APPARATUS WITH AUDIBLE AND/OR HAPTIC FEEDBACK

BACKGROUND

Many sports and recreational activities involve a person swinging a given type of sports-related implement. For example, in the sport of golf a golfer swings a golf club in an attempt to hit a golf ball. In the sport of baseball, a batter swings a baseball bat in an attempt to hit a baseball. In the sport of tennis, a tennis player swings a tennis racquet in an attempt to hit a tennis ball. In the sport of hockey, a player swings a hockey stick in an attempt to hit a hockey puck.

SUMMARY

As described herein, a "Swing Trainer" provides a mechanism that generates either or both an audible and/or a haptic click in response to a smoothness of a swing of a sports-related implement. In other words, the Swing Trainer clicks in a way that a user can either or both hear and/or feel during a swing of the sports-related implement. Such sports-related implements include, but are not limited to, golf clubs, tennis racquets, hockey sticks, baseball bats, lacrosse sticks, cricket bats, or any other sports-related implement wherein smoothness of a user swing is desirable. For purposes of discussion, the sports-related implement will be described with respect to a golf club. However, it is understood that the Swing Trainer is adaptable for use with other sports-related implements.

For example, in one implementation, the Swing Trainer is instantiated as a swing training device. This swing training device generally comprises a sports-related implement having a proximal section for gripping the sports-related implement. In addition, the sports-related implement includes a distal section for contacting a sports-related object (e.g., golf ball, baseball, hockey puck, etc.). Further, the swing training device includes a transverse slide mechanism rotatably coupled to and connecting shafts comprising a longitudinal axis of each of the proximal section and the distal section of the sports-related implement. Additionally, in this exemplary implementation, the transverse slide mechanism is configured to generate a click during a swing of the sports-related implement when a sliding force imparted to the transverse slide mechanism by the swing exceeds a static holding force (e.g., friction or other force) of the transverse slide mechanism. Finally, in this exemplary implementation, the transverse slide mechanism is further configured to rotate relative to a swing axis of the sports-related implement. Advantageously, any rotation of the transverse slide mechanism away from the swing axis of the sports-related implement adjusts the transverse slide mechanism by generating a corresponding decrease in the sliding force during a swing of the sports-related implement.

Similarly, in another implementation, the Swing Trainer is instantiated as a golf club. In general, this golf club comprises a hand grip on a proximal section of the golf club. In addition, this golf club further comprises a head on a distal section of the golf club. In this exemplary implementation, a proximal end of a transverse slide mechanism is coupled to a first shaft comprising a longitudinal axis of the proximal section the golf club. Further, in this exemplary implementation, a distal end of the transverse slide mechanism is coupled to a second shaft comprising a longitudinal axis of the distal section of the golf club. In this exemplary implementation, the transverse slide mechanism of the golf club forms an axial coupling between the longitudinal axis of the proximal section the golf club and the longitudinal axis of the distal section of the golf club. In this exemplary implementation, the transverse slide mechanism is configured to generate a click during a swing of the golf club when a sliding force imparted to the transverse slide mechanism by the swing exceeds a static holding force of the transverse slide mechanism. Further, in this exemplary implementation, a striker assembly of the transverse slide mechanism includes oversize bolt holes for coupling to threaded bolt holes of an inboard bearing housing of the transverse slide mechanism. Finally, in this exemplary implementation, a click assembly of the transverse slide mechanism includes oversize bolt holes for coupling to threaded bolt holes of an outboard bearing housing of the transverse slide mechanism. Advantageously, the use of oversize bolt holes in the striker assembly causes an automatic alignment between the bolt holes of the striker assembly and the bolt holes of the inboard bearing housing during assembly of those components (e.g., when bolting those two components together).

In yet another implementation, the Swing Trainer is implemented in the form of a transverse slide mechanism configured for coupling to a sports-related implement. More specifically, in this exemplary implementation, a proximal end of the transverse slide mechanism is configured for rotatable coupling to a proximal section the sports-related implement. Similarly, in this exemplary implementation, a distal end of the transverse slide mechanism is configured for rotatable coupling to a distal section of the sports-related implement. As such, when coupled to both the proximal and distal sections of the sports-related implement, the transverse slide mechanism forms an axially rotatable coupling between the proximal section of the sports-related implement and the distal section of the sports-related implement. Further, when coupled to both the proximal and distal sections of the sports-related implement, the transverse slide mechanism is configured to generate a click during a swing of the sports-related implement when a sliding force imparted to the transverse slide mechanism by the swing exceeds a static holding force of the transverse slide mechanism. Finally, in this exemplary implementation, when coupled to both the proximal and distal sections of the sports-related implement, the transverse slide mechanism is configured to axially rotate relative to a swing axis of the sports-related implement. Advantageously, any rotation of the transverse slide mechanism away from the swing axis of the sports-related implement adjusts the transverse slide mechanism by causing a corresponding decrease in the sliding force during the swing of the sports-related implement.

It is noted that the foregoing Summary is provided to introduce a selection of concepts, in a simplified form, that are further described below in the Detailed Description. This Summary does not identify key features or essential features of the claimed subject matter, nor is it intended to be used as an aid in determining the scope of the claimed subject matter. Its sole purpose is to present some concepts of the claimed subject matter in a simplified form as a prelude to the more-detailed description that is presented below.

DESCRIPTION OF THE DRAWINGS

The specific features, aspects, and advantages of the Swing Trainer implementations described herein will become better understood with regard to the following description, appended claims, and accompanying drawings where:

DETAILED DESCRIPTION

Figure 1:
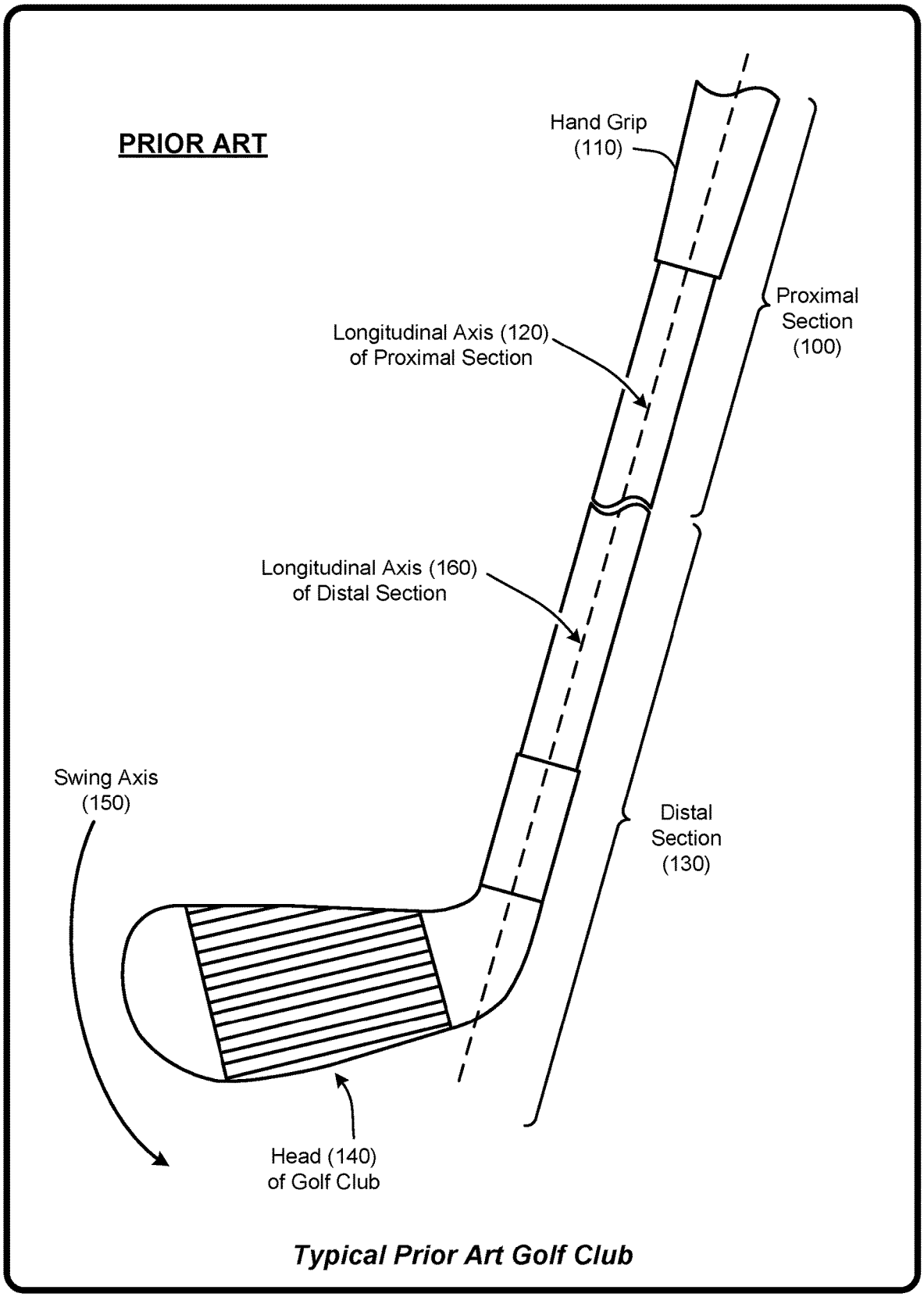
FIG. 1 is a diagram illustrating a typical PRIOR ART golf club.

In the following description of a "Swing Trainer", reference is made to the accompanying drawings which form a part hereof, and in which are shown, by way of illustration, specific implementations in which the Device can be realized. It is understood that other implementations can be utilized, and structural changes can be made, without departing from the intended scope of the various Swing Trainer implementations.

It is also noted that for the sake of clarity specific terminology will be resorted to in describing the Swing Trainer implementations described herein and it is not intended for these implementations to be limited to the specific terms so chosen. Furthermore, it is to be understood that each specific term includes all its technical equivalents that operate in a broadly similar manner to achieve a similar purpose. Reference herein to "one implementation", or "another implementation", or an "exemplary implementation", or an "alternate implementation", or "one version", or "another version", or an "exemplary version", or an "alternate version", or "one variant", or "another variant", or an "exemplary variant", or an "alternate variant" means that a particular feature, a particular structure, or particular characteristics described in connection with the implementation/version/variant can be included in at least one implementation of the Swing Trainer. The appearances of the phrases "in one implementation", "in another implementation", "in an exemplary implementation", "in an alternate implementation", "in one version", "in another version", "in an exemplary version", "in an alternate version", "in one variant", "in another variant", "in an exemplary variant", and "in an alternate variant" in various places in the specification are not necessarily all referring to the same implementation/version/variant, nor are separate or alternative implementations/versions/variants mutually exclusive of other implementations/versions/variants. Furthermore, the order of method flow representing one or more implementations, or versions, or variants of the Swing Trainer does not inherently indicate any particular order nor imply any limitations of the Device.

Furthermore, to the extent that the terms "includes," "including," "has," "contains," variants thereof, and other similar words are used in either this detailed description or the claims, these terms are intended to be inclusive, in a manner similar to the term "comprising", as an open transition word without precluding any additional or other elements.

1.0 Introduction:

In general, the Swing Trainer provides a transverse slide mechanism that generates either or both an audible and/or a haptic click in response to a smoothness of a swing of a sports-related implement. Such sports-related implements include, but are not limited to, golf clubs, tennis racquets, hockey sticks, baseball bats, lacrosse sticks, cricket bats, or any other sports-related implement wherein smoothness of a user swing is desirable.

The Swing Trainer rotatably couples a proximal end to a distal end of the sports-related implement. For purposes of discussion, the proximal end of the sports-related implement will be described as an end of the sports-related that includes a user grip or the like (e.g., the portion of the sports-related implement held by a user when swinging that sports-related implement). Further, for purposes of discussion, the distal end of the sports-related implement will be described as an end of the sports-related that is designed or intended to hit or otherwise contact a sports-related object (e.g., golf ball, baseball, hockey puck, etc.) during a swing of the sports-related implement. For example, as illustrated by FIG. 1, a typical Prior Art golf club comprises a proximal section 100 that includes a handgrip or the like 110. In addition, a first longitudinal axis 120 defines a shaft of the proximal section. Similarly, a distal section 130 of the golf club includes a head 140 for striking a golf ball (not shown) when the golf club is swung along swing axis 150. Finally, a second longitudinal axis 160 defines a shaft of the distal section. Typically, the shaft of the proximal section is integral or otherwise connected to the shaft of the second section. In other words, a typical prior art golf club (and many other sports-related implements) includes an integral or continuous shaft or body covering the length from the hand grip 110 to the head 140.

In various implementations, the Swing Trainer is constructed by modifying a Prior Art golf club such as that illustrated by FIG. 1, or any other sports-related implements. For example, in various implementations, the Swing Trainer is fabricated by providing a sports-related implement having a longitudinal section, a proximal end of the longitudinal section further comprising a grip and a distal end of the longitudinal section having a contact surface for contacting a sports-related object. If not already cut or otherwise sectioned, the longitudinal section of the sports-related implement is cut between the proximal end the distal end. Then, the transverse slide mechanism is rotatably coupled between the cut ends of the longitudinal section, thereby rotatably reconnecting the proximal end and the distal end of the sports-related implement. Advantageously, this modification to existing sports-related implements via the insertion of the transverse slide mechanism causes the resulting Swing Trainer to generate a click during a swing of the sports-related implement when a sliding force imparted to the transverse slide mechanism by the swing exceeds a static holding force of the transverse slide mechanism. Further, it should be clear that, rather than modifying an existing sports-related implement, the transverse slide mechanism of the Swing Trainer can be rotatably coupled to proximal and distal sections of the components used during an initial construction of that sports-related implement. In other words, existing sports-related implements can be modified to incorporate the transverse slide mechanism, or the sports-related implements can be initially constructed to incorporate the transverse slide mechanism. In either case, operation of the resulting swing trainer is the same.

2.0 Operational Details of the Swing Trainer:

The above-described devices, components, etc., are employed for instantiating various implementations of the Swing Trainer. As summarized above, the Swing Trainer provides a transverse slide mechanism that is rotatably coupled to a sports-related implement in a way that generates an audible and/or haptic click in response to a smoothness of a swing of that sports-related implement. The following sections provide a detailed discussion of the operation of various implementations of the Swing Trainer, and of exemplary methods and techniques for implementing various features of the Swing Trainer. In particular, the following sections provides examples and operational details of various implementations of the Swing Trainer, including:

An operational overview of the Swing Trainer;

Transverse slide assembly overview;

Exemplary use of the transverse slide mechanism with various sports-related implements;

Exemplary components of the transverse slide mechanism;

Rotational coupling between the transverse slide mechanism and sports-related implements; and Curved slider assembly of the transverse slide mechanism.

2.1 Operational Overview:

As mentioned, the Swing Trainer rotatably couples a proximal end to a distal end of a sports-related implement. A transverse slide mechanism of the Swing Trainer then generates an audible and/or haptic click when a sliding force imparted to the Swing Trainer by a user swing of the Swing Trainer exceeds a static holding force (e.g., friction or other force) of the transverse slide mechanism.

In operation, the Swing Trainer is optionally rotated prior to a user swing so as to adjust the transverse slide mechanism to increase or decrease the sliding force imparted by the swing. More specifically, rotating the Swing Trainer away from a swing axis of the sports-related implement decreases the sliding force applied to overcome the static holding force of the transverse slide mechanism. Conversely, rotating the Swing Trainer towards the swing axis of the sports-related implement increases the sliding force applied to overcome the static holding force of the transverse slide mechanism. In various implementations, the highest amount of sliding force is applied to the transverse slide mechanism during a swing when that transverse slide mechanism is rotated such that it slides or shifts inline with the swing axis of the sports-related implement. In other words, the highest sliding force occurs at a zero-degree rotation of the transverse slide mechanism relative to the swing axis of the sports-related implement. Conversely, the lowest sliding force occurs at a ninety-degree rotation of the transverse slide mechanism relative to the swing axis of the sports-related implement.

In the following paragraphs, various physical components and implementations of the Swing Trainer are described with respect to FIG. 2 through FIG. 15. FIG. 2 through FIG. 15 are not intended to provide an exhaustive representation of all of the various possible components and implementations of the Swing Trainer described herein, and these figures are provided only for purposes of explanation. Further, any components and interconnections between such components of the Swing Trainer may be implemented using any desired materials, and component sizes, shapes, and interfaces, that are sufficient to achieve the functionality described herein. Further, some of the components of the Swing Trainer may be described as optional or alternate implementations. Any or all such optional or alternate implementations or components may be used in combination with other any of the components or implementations, optional or otherwise, that are described throughout this document. Further, while various components of the Swing Trainer may be illustrated or described herein with respect to various shapes or geometries for purposes of discussion, the Swing Trainer is not limited to the particular sizes, shapes, appearances, or other features illustrated, but rather by the functionality of the Swing Trainer described herein.

Figure 2:
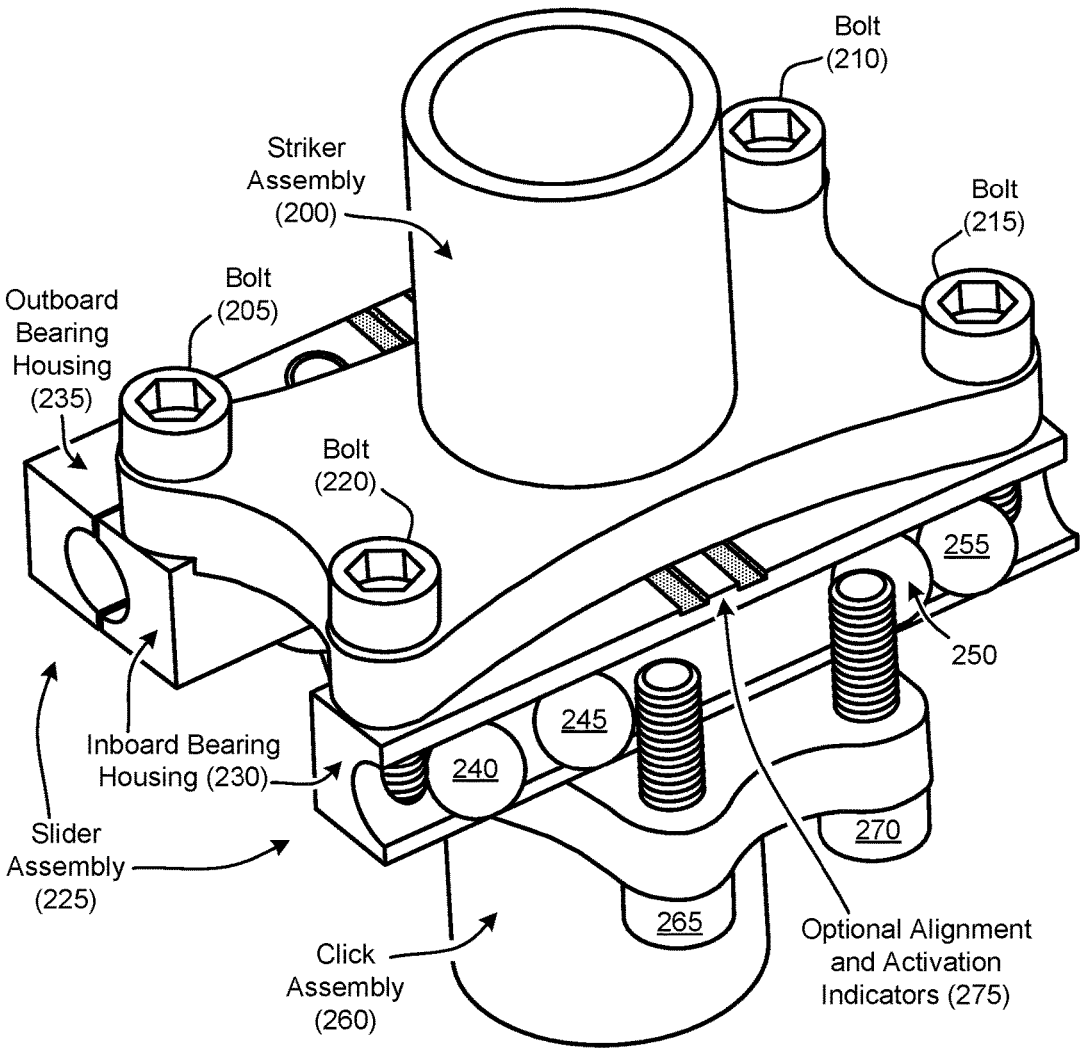
FIG. 2 is a diagram illustrating a partial perspective view of an exemplary implementation of the transverse slide mechanism of the Swing Trainer, as described herein.

2.1 Transverse Slide Mechanism Overview:

In general, FIG. 2 illustrates a partial perspective view of an exemplary implementation of the transverse slide mechanism of the Swing Trainer. As illustrated, this exemplary implementation of the transverse slide mechanism includes a striker assembly 200 that is bolted (e.g., 205, 210, 215, 220) or otherwise coupled to a slider assembly 225. In various implementations, the slider assembly 225 comprises an inboard bearing housing 230 or the like in combination with an outboard bearing housing 235. As further illustrated, the striker assembly 200 is bolted or otherwise coupled to the inboard bearing housing 230 portion of the slider assembly 225. Advantageously, the use of the separate inboard bearing housing 230 and the outboard bearing housing 235 of the slider assembly 225 enables the use of small lightweight components relative to a one- or two-piece slider assembly (not shown). As such, a weight of the overall slider assembly, and thus the weight of the overall transverse slide mechanism, is reduced relative to a transverse slide mechanism having a one- or two-piece slider assembly. As a further advantage, the use of these small lightweight components increases an internal volume (e.g., an open void) within the transverse slide assembly that increases a volume of the audible click. As yet another advantage, the use of these small lightweight components relative to a one- or two-piece slider assembly increases the strength of the haptic click. In other words, the use of these small lightweight components produces a haptic click that is stronger, and thus better felt by the user.

In related implementations, the bolt holes in the striker assembly 200 are slightly oversized (non-threaded), while the bolt holes in the inboard bearing housing 230 are threaded to receive the bolts (e.g., 205, 210, 215, 220). The use of oversize bolt holes in the striker assembly 200 causes the inboard bearing housing 230 to adjust or shift relative to the striker assembly when the striker assembly is bolted to the inboard bearing housing. More specifically, when machining various components of the transverse slide mechanism, it is common that manufacturing tolerances or irregularities will cause a slight offset or misalignment between the bolt holes of the striker assembly 200 and the bolt holes of the inboard bearing housing 230. Advantageously, the use of oversize bolt holes in the striker assembly 200 causes an automatic alignment between the bolt holes of the striker assembly and the bolt holes of the inboard bearing housing 230 during assembly of those components (e.g., when bolting those two components together). In other words, the use of these oversize bolt holes simplifies assembly and reduces the importance of tight component tolerances by enabling the components to self-align during assembly.

For purposes of illustration, a portion of the outboard bearing housing 235 is omitted from the foreground of FIG. 2 to show a plurality of ball bearings (e.g., 240, 245, 250 and 255). In this exemplary implementation, a click assembly 260 is bolted (e.g., 265 and 270, with corresponding bolts (see 605 and 610 of FIG. 6) not visible in the background of FIG. 2) or otherwise coupled to the slider assembly 225. As illustrated, the click assembly 260 is bolted or otherwise coupled to the outboard bearing housing 235 portion of the slider assembly 225. Alternately, the striker assembly 200 may be bolted or otherwise coupled to the outboard bearing housing 235 portion of the slider assembly 225, while the click assembly 260 is in turn bolted or otherwise coupled to the inboard bearing housing 230 portion of the slider assembly 225. In either case, the bolts (e.g., 205, 210, 215, 220, 265, 270, and corresponding bolts not visible in the background of FIG. 2) also ensure that the plurality of ball bearings (e.g., 240, 245, 250 and 255) are retained within the slider assembly 225, thereby slidably coupling the striker assembly 200 to the click assembly 260 via the slider assembly 225. Advantageously, the use of the bolts to retain the ball bearings within a relatively narrow range of motion relative to those bolts enables the use of fewer ball bearings relative to a longer channel that might exist in a one- or two-piece slider assembly.

In related implementations, the bolt holes in the click assembly 260 are slightly oversized (non-threaded), while the bolt holes in the outboard bearing housing 235 are threaded to receive the bolts (e.g., 265, 270, 605 and 610). The use of oversize bolt holes in the click assembly 260 causes the outboard bearing housing 235 to adjust or shift relative to the click assembly when the click assembly is bolted to the outboard bearing housing. More specifically, when machining various components of the transverse slide mechanism, it is common that manufacturing tolerances or irregularities will cause a slight offset or misalignment between the bolt holes of the click assembly 260 and the bolt holes of the outboard bearing housing 235. Advantageously, the use of oversize bolt holes in the click assembly 260 causes an automatic alignment between the bolt holes of the click assembly and the bolt holes of the outboard bearing housing 235 during assembly of those components (e.g., when bolting those two components together). In other words, the use of these oversize bolt holes simplifies assembly and reduces the importance of tight component tolerances by enabling the components to self-align during assembly.

As a further advantage, the combined use of oversize non-threaded bolt holes in both the striker assembly 200 and the click assembly 260 causes both the striker assembly and the click assembly to automatically align with the bolt holes of the inboard bearing housing 230 and the outboard bearing housing, respectively, thereby causing an automatic alignment of the overall slider assembly 225 with the striker assembly and the click assembly. Advantageously, this automatic alignment of the striker assembly 200 and the click assembly 260 with the overall slider assembly 225 obviates misalignment problems otherwise resulting from manufacturing irregularities and/or tolerance stacking when manufacturing any or all of the striker assembly, the click assembly, the inboard bearing housing 230 and/or the outboard bearing housing 235.

Figure 3:
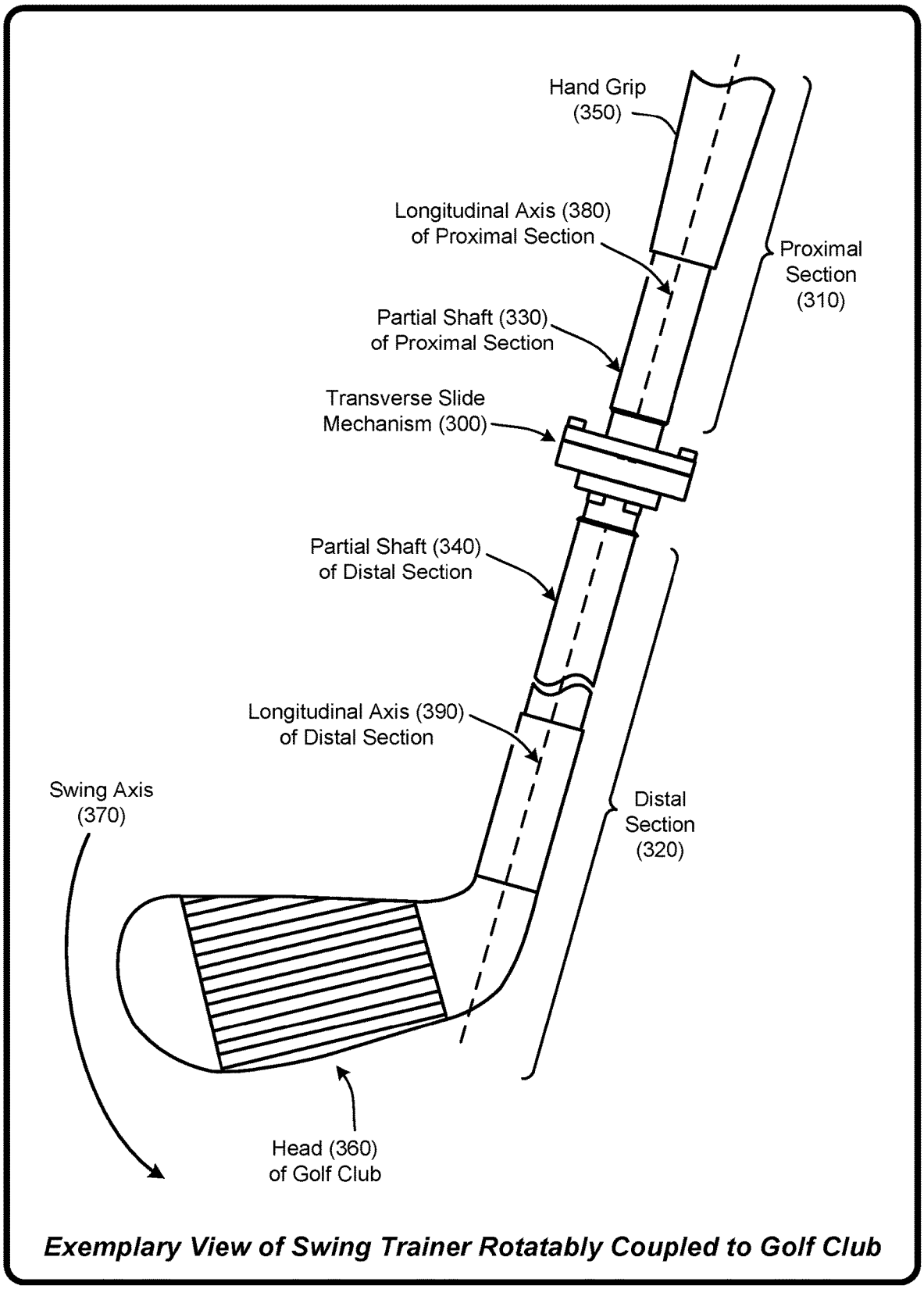
FIG. 3 is a diagram illustrating a partial side view, in simplified form, of an exemplary implementation of the transverse slide mechanism of the Swing Trainer coupled to, and connecting, a distal section of a golf club comprising a club head coupled to a partial shaft and a proximal section of the golf club comprising a grip coupled to a partial shaft, as described herein.

Finally, in various implementations, the transverse slide mechanism includes optional alignment and activation indicators 275. In general, as described in further detail herein, in various implementations, the optional alignment and activation indicators 275 provide a visual indication of whether or not the transverse slide mechanism has activated (e.g., it has slid or shifted transversely in response to a swing of a coupled sports-related implement), thereby generating the aforementioned click. In further implementations, the optional alignment and activation indicators 275 provide a visual indication of a rotation angle relative to a swing axis of a coupled sports-related implement. Further, in various implementations, the optional alignment and activation indicators 275 provide a visual indication of both activation and rotation angle 2.2 Exemplary Use of the Transverse Slide Mechanism with Various Sports-Related Implements:

In general, FIG. 3 illustrates a partial side view, in simplified form, of an exemplary implementation of the transverse slide mechanism 300 rotatably coupled to, and connecting, a proximal section 310 of a golf club to a distal section 320 of the golf club. More specifically, as illustrated, the proximal section 310 of the golf club includes a first partial shaft 330 that is coupled to the transverse slide mechanism 300. Similarly, as illustrated, the distal section of the golf club includes a second partial shaft 340 that is coupled to the transverse slide mechanism 300. In various implementations, one or both of the couplings between the transverse slide mechanism 300 and the first and second partial shafts (330 and 340) are rotatable couplings.

As further illustrated by FIG. 3, as with a typical golf club, the proximal section 310 of the golf club includes a hand grip 350 or the like. Further, as with a typical golf club, the distal section 320 of the golf club includes a head 360 or the like for striking golf balls when the golf club is swung along swing axis 370. As illustrated, prior to activation of the transverse slide mechanism 300 during a swing of the golf club, a first longitudinal axis 380 of the proximal section 310 is in substantial alignment with a second longitudinal axis of the distal section 320. In response to a swing of the golf club, the transverse slide mechanism 300 may activate (e.g., slide or shift transversely), thereby generating the aforementioned click, and causing the first longitudinal axis 380 of the proximal section 310 to be out of alignment (not shown in FIG. 3) with the second longitudinal axis of the distal section 320.

Figure 4:
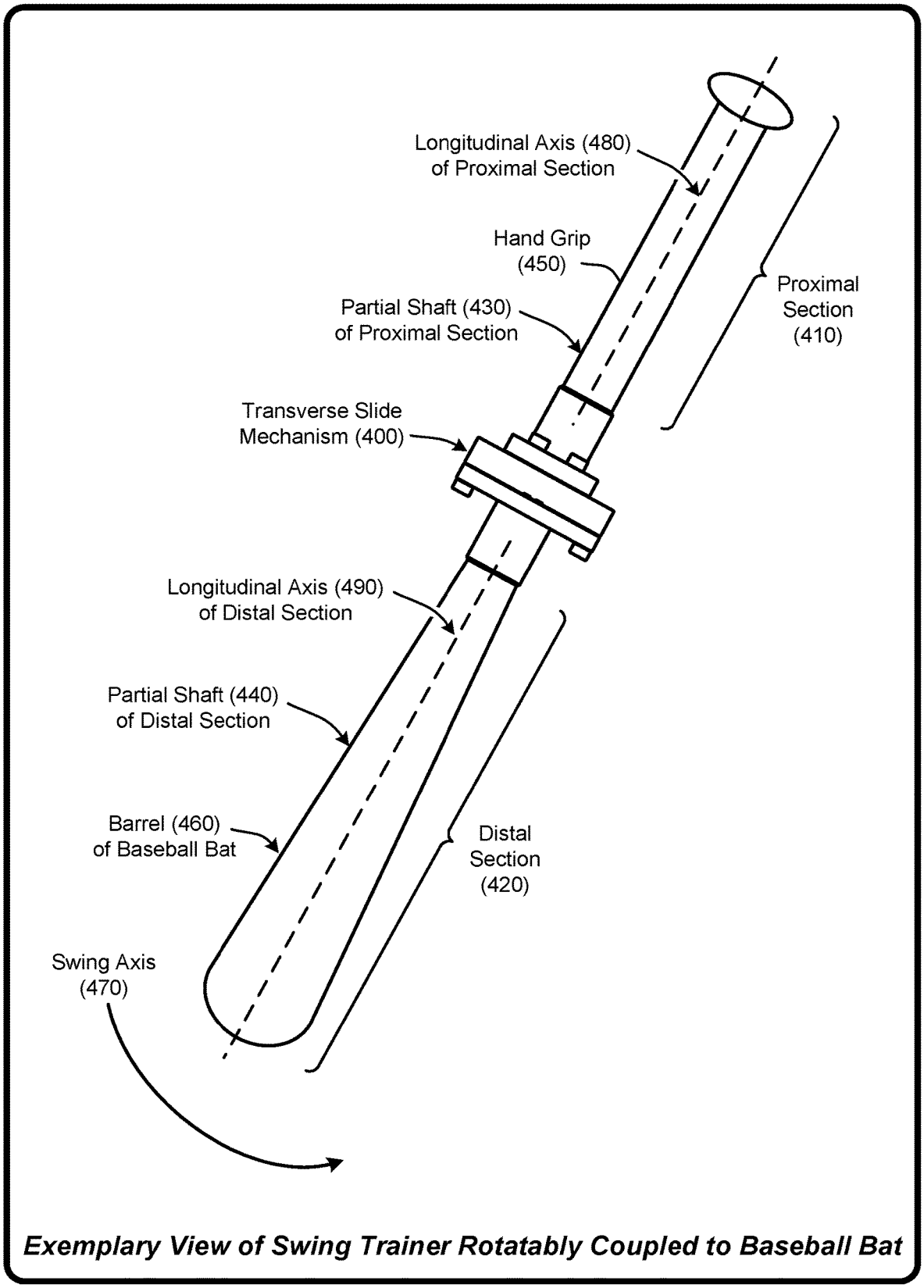
FIG. 4 is a diagram illustrating a partial side view, in simplified form, of an exemplary implementation of the transverse slide mechanism of the Swing Trainer coupled to, and connecting, a distal section of a baseball bat to a proximal section of the baseball bat, as described herein.

Similarly, FIG. 4 illustrates a side view, in simplified form, of an exemplary implementation of the transverse slide mechanism 400 rotatably coupled to, and connecting, a proximal section 410 of a baseball bat club to a distal section 420 of the baseball bat. More specifically, as illustrated, the proximal section 410 of the baseball bat includes a first partial shaft 430 that is coupled to the transverse slide mechanism 400. Similarly, as illustrated, the distal section of the baseball bat includes a second partial shaft 440 that is coupled to the transverse slide mechanism 400. In various implementations, one or both of the couplings between the transverse slide mechanism 400 and the first and second partial shafts (430 and 440) are rotatable couplings.

As further illustrated by FIG. 4, as with a typical baseball bat, the proximal section 310 of the baseball bat includes a hand grip 450 or the like. Further, as with a typical baseball bat, the distal section 420 of the baseball bat includes a barrel 360 or the like for striking baseballs when the baseball bat is swung along swing axis 470. As illustrated, prior to activation of the transverse slide mechanism 400 during a swing of the baseball bat, a first longitudinal axis 480 of the proximal section 410 is in substantial alignment with a second longitudinal axis of the distal section 420. In response to a swing of the baseball bat, the transverse slide mechanism 400 may activate (e.g., slide or shift transversely), thereby generating the aforementioned click, and causing the first longitudinal axis 480 of the proximal section 410 to be out of alignment (not shown in FIG. 4) with the second longitudinal axis of the distal section 420.

2.3 Exemplary Components of the Transverse Slide Mechanism:

The following paragraphs refer to FIG. 5 through FIG. 15 while describing various components of the transverse slide mechanism of FIG. 2. As such, for purposes of explanation and consistency, in describing each of FIG. 5 through FIG. 15, reference will be made to some or all of the same element numbers presented with respect to FIG. 2. Similarly, components or elements introduced in one figure will be used to identify like elements in later figures with respect to FIG. 2 and FIG. 5 through FIG. 15.

2.3.1 Striker Assembly of the Transverse Slide Mechanism:

In general, the striker assembly of the transverse slide mechanism is coupled to a top section of the slider assembly. A striker member of the striker assembly extends through an open cavity or the like of the slider assembly and further extends into an open cavity or the like of the click assembly. When activated (e.g., transverse sliding of the transverse slide mechanism), the striker member strikes a striking surface of click assembly. In various implementations, the striking surface is flat, inwardly or outwardly curved, pointed, etc. For example, in various implementations, the use of an outwardly curved striking surface (e.g., see elements 520 and 521 of FIG. 5 and FIG. 6) decreases a surface area of the striking surface that is struck be the striking member. Advantageously, decreasing the surface area of the striking surface causes an increase in the volume of the audible click relative to a flat surface having a relatively larger striking surface. In other words, the use of a small or point contact between the striker member and the striking surface increases the volume of the audible click.

Figure 5:
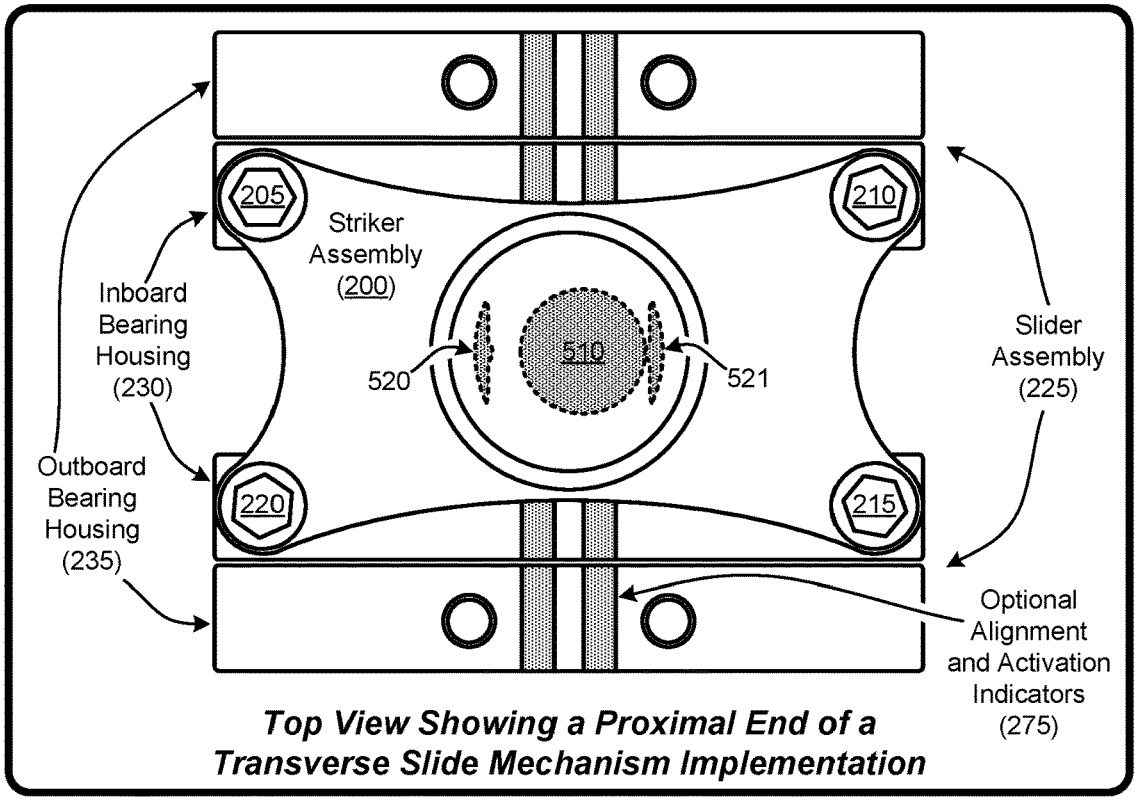
FIG. 5 is a diagram illustrating a top view showing a proximal end of a transverse slide mechanism of an exemplary implementation of a Swing Trainer, as described herein.
Figure 6:
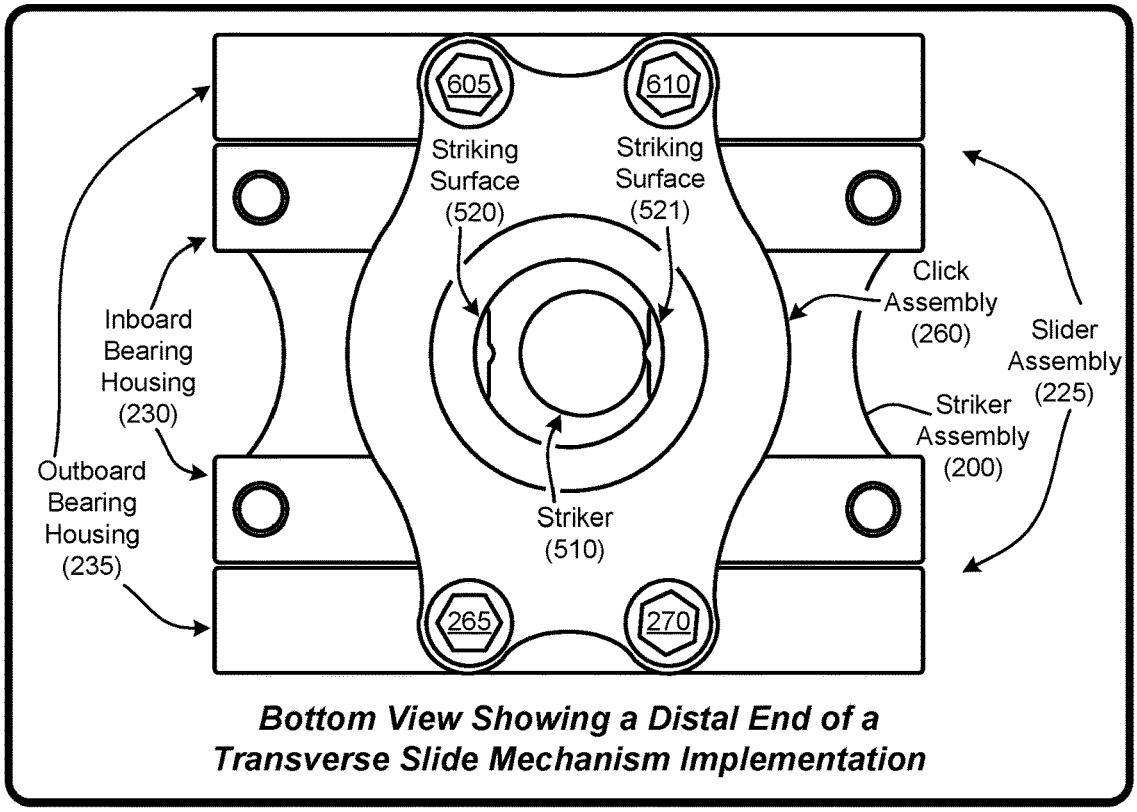
FIG. 6 is a diagram illustrating a bottom view showing a distal end of the transverse slide mechanism of FIG. 5, as described herein.

FIG. 5 shows a partially transparent top view of the transverse slide mechanism that illustrates a proximal end (e.g., a top view) of the transverse slide mechanism. More specifically, as illustrated by FIG. 5, the striker assembly 200 is bolted (e.g., bolts 205, 210, 220, 215) or otherwise coupled to the inboard bearing housing 230 of the slider assembly 225. In turn, as illustrated by FIG. 6, the click assembly 260 is bolted to the outboard bearing housing 235 of the slider assembly 225. Alternately (not shown in FIG. 5 or FIG. 6) the striker assembly 200 may be coupled to the outboard bearing housing 235 while the click assembly 260 is in turn coupled to the inboard bearing housing. So long as the striker assembly 200 and the click assembly 260 are coupled to different bearing housings (e.g., 230 and 235), the slider assembly is capable of shifting transversely, thereby causing both a click and a longitudinal axis offset between the striker assembly 200 and the click assembly 260.

Returning to FIG. 5, the striker assembly 200 includes a striker 510 that extends through the slider assembly 225 and into the click assembly 260. The length of the striker 510 is sufficient to allow the striker to contact either striking surface 520 or striker surface 521 of the striker assembly 200. In various implementations, the striker 510 is integral to the striker assembly 200. Alternately, the striker 510 is permanently or removably coupled to striker assembly 200 (e.g., pined, glued, bolted, etc.). The striker 510 of the striker assembly 200 is discussed in further detail in with respect to FIG. 12 through FIG. 14 in Section 2.3.6 of this document.

FIG. 5 also illustrates the optional alignment and activation indicators 275, shown with those indicators in an aligned (e.g., non-activated) position wherein the longitudinal axis of the striker assembly 200 is inline with the longitudinal axis of the click assembly 260.

2.3.2 Click Assembly of the Transverse Slide Mechanism:

FIG. 6 shows a bottom view of the transverse slide mechanism that illustrates a distal end (e.g., a bottom view) of the transverse slide mechanism. More specifically, as illustrated by FIG. 6, the click assembly 260 is bolted (e.g., bolts 265, 270, 605, 610) or otherwise coupled to the outboard bearing housing 235 of the slider assembly 225. In turn, as illustrated by FIG. 5, the striker assembly 200 is bolted to the inboard bearing housing 230 of the slider assembly 225. Returning to FIG. 6, the click assembly 260 includes one or more striking surfaces (e.g., 520 and 521) disposed with the click assembly and configured to contact the striker 510 upon a transverse shift of the transverse shift mechanism. In various implementations, the striking surfaces (e.g., 520 and 521) are is integral to the click assembly 260. Alternately, the striking surfaces (e.g., 520 and 521) are permanently or removably coupled to click assembly 260 (e.g., pined, glued, bolted, etc.).

2.3.3 Interaction between Striker Assembly and Click Assembly:

In general, upon the aforementioned transverse shift of the slider assembly from an initially aligned position, and the corresponding shift of the striker assembly relative to the click assembly (thereby shifting the transverse slide mechanism into an out-of-alignment state with respect to the longitudinal axes of the striker assembly and the click assembly), the striker contacts the opposing striking surface to generate the click. Advantageously, in various implementations, a shift of the transverse slide mechanism back into alignment of the longitudinal axes of the striker assembly and the click assembly also generates a click upon contact of the striker with the striking surface. In related implementations, the striking surface (of the initially aligned position) is coated with, or formed from, a material (e.g., rubber, polymer, etc.) that prevents click generation upon return of the transverse slide mechanism back into alignment of the longitudinal axes of the striker assembly 200 and the click assembly 260. As such, in this implementation, clicks are only generated upon the transverse shift to the out-of-alignment position of the transverse slide mechanism during a swing of the sports-related implement to which the transverse slide mechanism is coupled. This transverse shift process is illustrated by FIG. 7 and FIG. 8.

Figure 7:
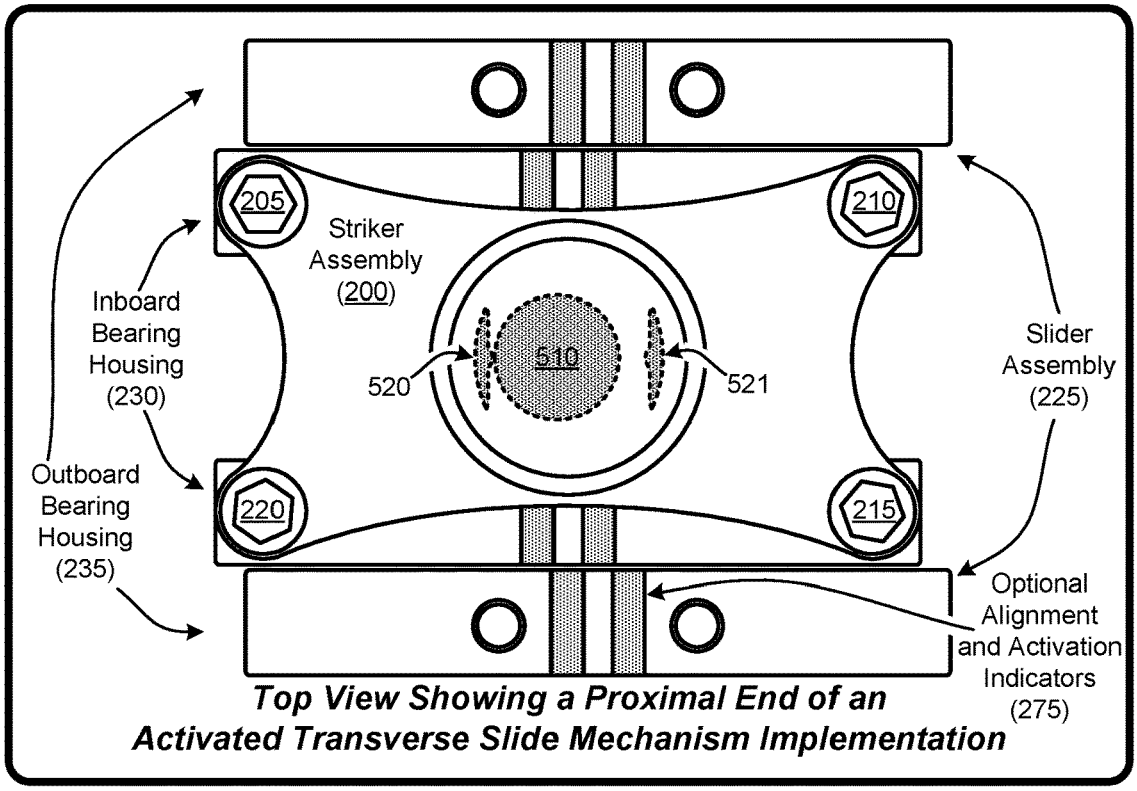
FIG. 7 is a diagram illustrating the top view of the proximal end of the transverse slide mechanism of FIG. 5, showing the transverse slide mechanism in an activated position, as described herein.

For example, FIG. 7 illustrates a top view that shows the proximal end of the transverse slide mechanism of FIG. 2. More specifically, FIG. 7 shows the transverse slide mechanism in an activated position, e.g., the out-of-alignment state with respect to the longitudinal axes of the striker assembly 200 and the click assembly 260 (not visible in FIG. 7). As illustrated by FIG. 7, the inboard bearing housing 230 of the slider assembly 225 shifts transversely relative to the outboard bearing housing 235. This shift can be visually observed via the optional alignment and activation indicators 275. During the activation (i.e., the transverse shift) of the transverse slide mechanism to the out-of-alignment position, the striker 510 of the striker assembly 200 contacts the striking surface 520, thereby generating the click.

Figure 8:
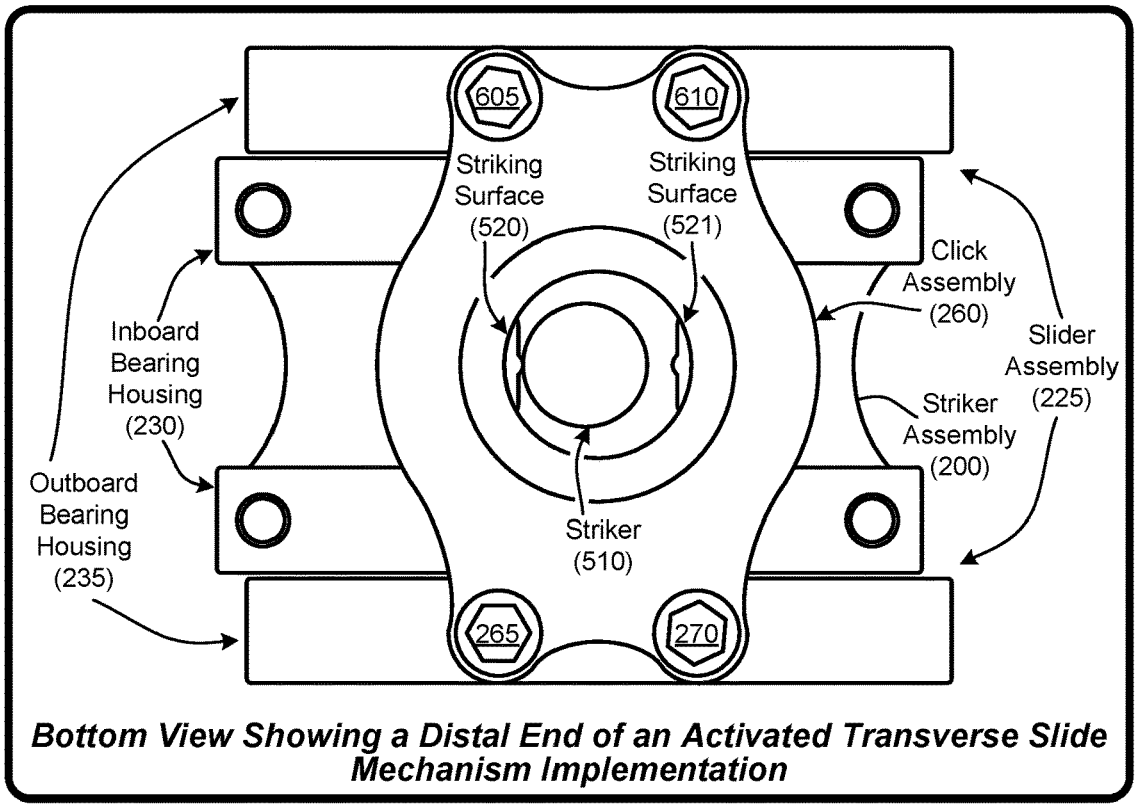
FIG. 8 is a diagram illustrating the bottom view of the distal end of the transverse slide mechanism of FIG. 5, showing the transverse slide mechanism in an activated position, as described herein.

FIG. 8 illustrates the same activated state of the transverse slide mechanism shown by FIG. 7 from a bottom view that shows the distal end of the transverse slide mechanism of FIG. 2. In particular, as illustrated by FIG. 8, the inboard bearing housing 230 of the slider assembly 225 shifts transversely relative to the outboard bearing housing 235. During the activation (i.e., the transverse shift) of the transverse slide mechanism to the out-of-alignment position, the striker 510 of the striker assembly 200 contacts the striking surface 520, thereby generating the click.

Figure 9:
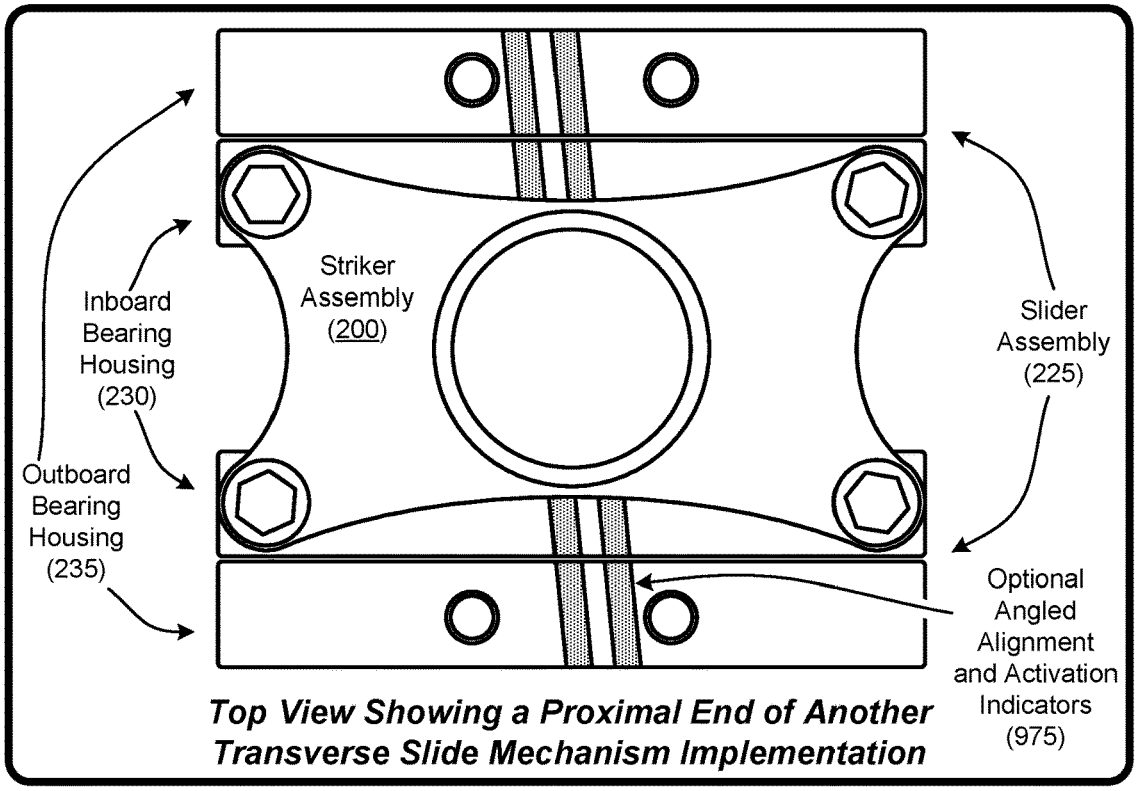
FIG. 9 is a diagram illustrating a top view showing a proximal end of a transverse slide mechanism of another exemplary implementation of the Swing Trainer, as described herein.
Figure 10:
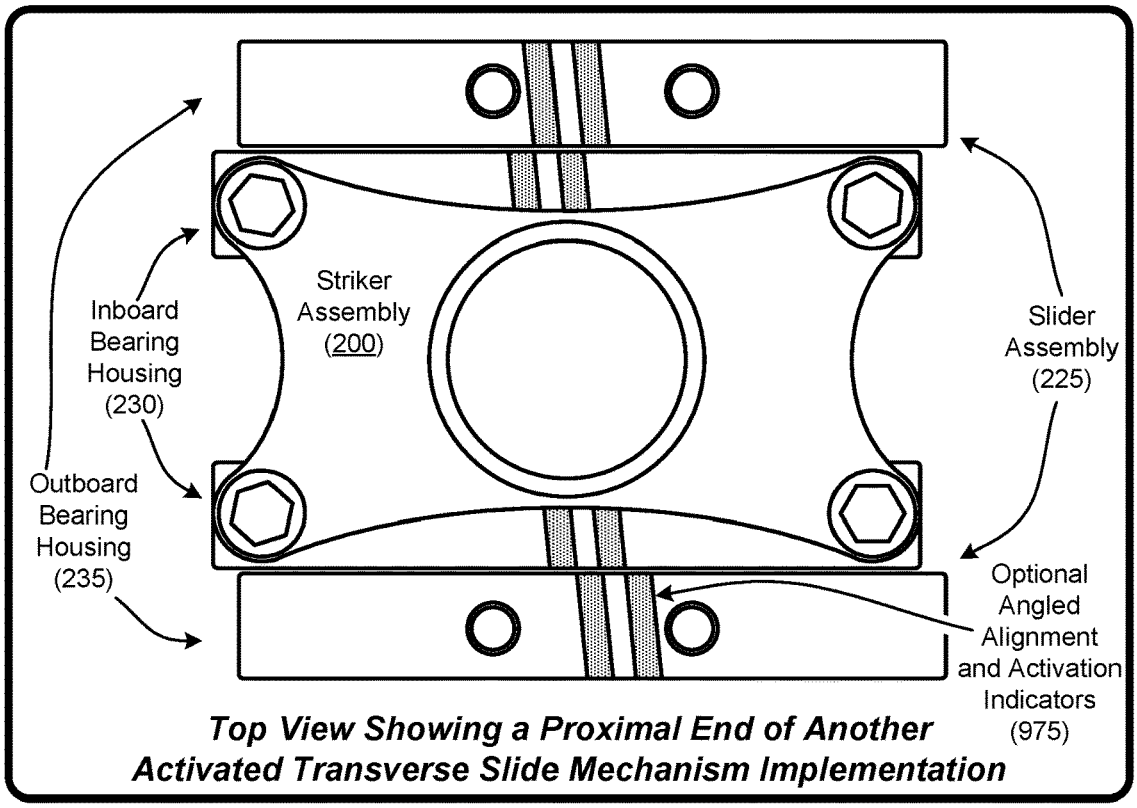
FIG. 10 is a diagram illustrating the top view of the proximal end of the transverse slide mechanism of FIG. 9, showing the transverse slide mechanism in an activated position, as described herein.

2.3.4 Alignment and Angle Indicators of Transverse Slide Mechanism:

The combination of FIG. 9 and FIG. 10 illustrate top views of the proximal end of the transverse slide mechanism showing the transverse slide mechanism in a non-activated position and an activated position, respectively. In addition, FIG. 9 and FIG. 10 illustrate an angled instance of the optional alignment and activation indicators 975. In general, the optional alignment and activation indicators can be formed in any desired size, color, shape, angle, pattern, curve, etc., that visibly illustrates the shift from the non-activated position to the activated position of the transverse slide mechanism. In the case of FIG. 9, the angled instance of the optional alignment and activation indicators 975 is shown as aligned, prior to the transverse shift of the inboard bearing housing 230 relative to the outboard housing 235 of the slider assembly 225 during activation of the transverse slide mechanism. Similarly, in the case of FIG. 10, the angled instance of the optional alignment and activation indicators 975 is shown as not being aligned, subsequent to the transverse shift of the inboard bearing housing 230 relative to the outboard housing 235 of the slider assembly 225 during activation of the transverse slide mechanism.

Figure 11:
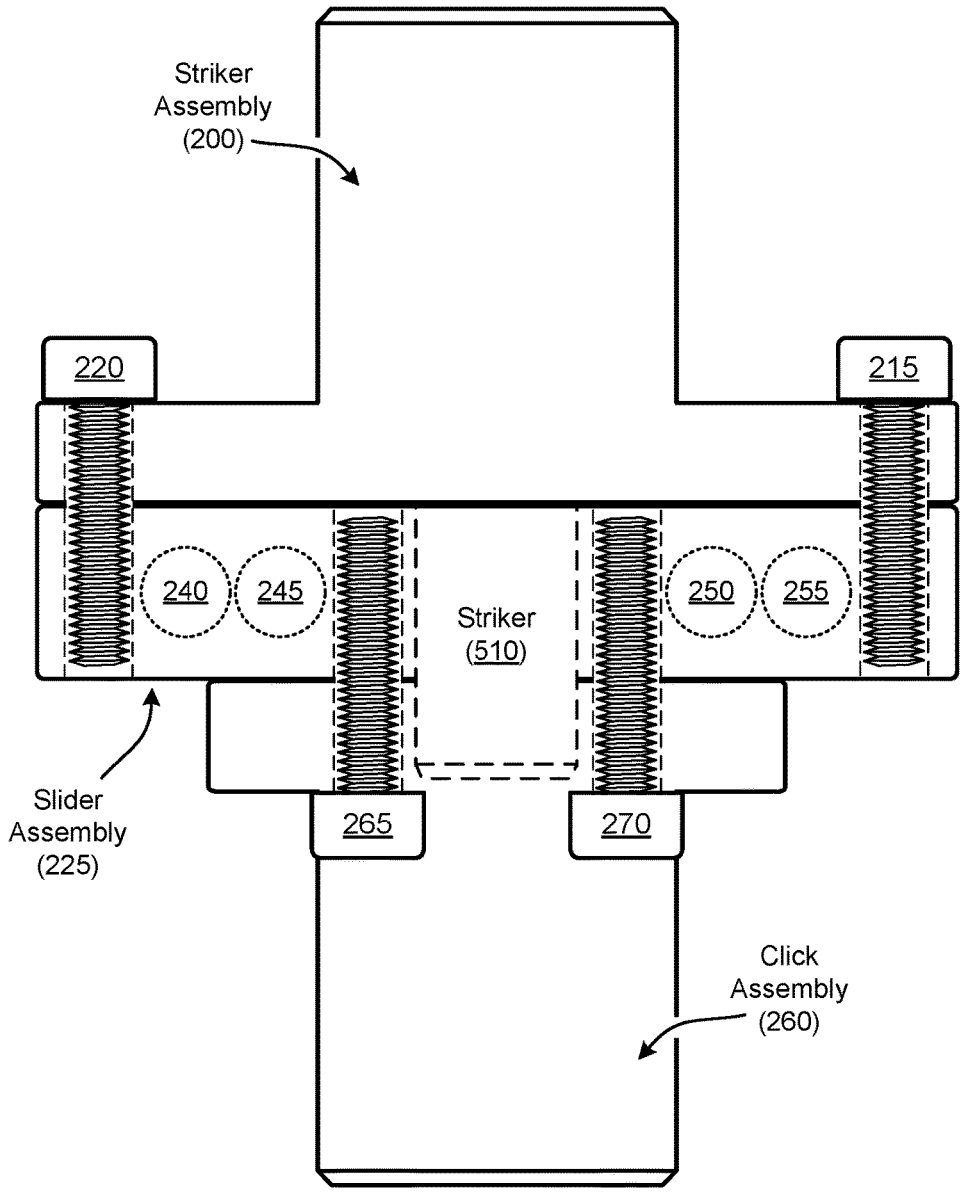
FIG. 11 is a diagram illustrating a partially transparent left side view of an exemplary implementation of the transverse slide mechanism of the Swing Trainer, as described herein.

2.3.5 Coupling between Striker Assembly and Click Assembly:

In general, the aforementioned slider assembly is coupled to and between the striker assembly and the click assembly to form a slidable coupling between the striker assembly and the click assembly. For example, as illustrated by FIG. 11 it can be seen that the striker assembly 200 is not directly connected to the click assembly 260. Instead, in various implementations, the slider assembly 225 provides a slidable coupling between the striker assembly 200 and the click assembly 260. More specifically, in various implementations, the striker assembly 200 is bolted or otherwise coupled to a top surface (e.g., the inboard bearing housing (not shown)) of the slider assembly 225. In various implementations, rather than being bolted or otherwise coupled to the top surface of the slider assembly 225, the top surface of the slider assembly is integral to the striker assembly 200. Similarly, in various implementations, the click assembly 260 is bolted or otherwise coupled to a bottom surface (e.g., the outboard bearing housing (not shown)) of the slider assembly 225. In various implementations, rather than being bolted or otherwise coupled to the bottom surface of the slider assembly 225, the bottom surface of the slider assembly is integral to the click assembly 260. Further, the bolts (e.g., 215, 220, 265, and 270, and corresponding bolts not visible in the background of FIG. 11) ensure that the plurality of ball bearing (e.g., 240, 245, 250 and 255), or roller bearings or the like, are retained within the slider assembly 225, thereby slidably coupling the striker assembly 200 to the click assembly 260 via the slider assembly 225.

2.3.6 Slider Assembly of the Transverse Slide Mechanism:

As discussed, the slider assembly of the transverse slide mechanism is configured to shift transversely in response to a swing of the sports-related implement to which the overall transverse slide mechanism is coupled. As such, the couplings between the striker assembly and the slider assembly and between the click assembly and the slider assembly, causes a transverse shift between the striker assembly and the click assembly 260 during the transverse shift of the slider assembly. In addition, the transverse shift between the striker assembly and the click assembly causes the striker of the striker assembly to contact the striking surface(s), thereby generating the click.

Figure 12:
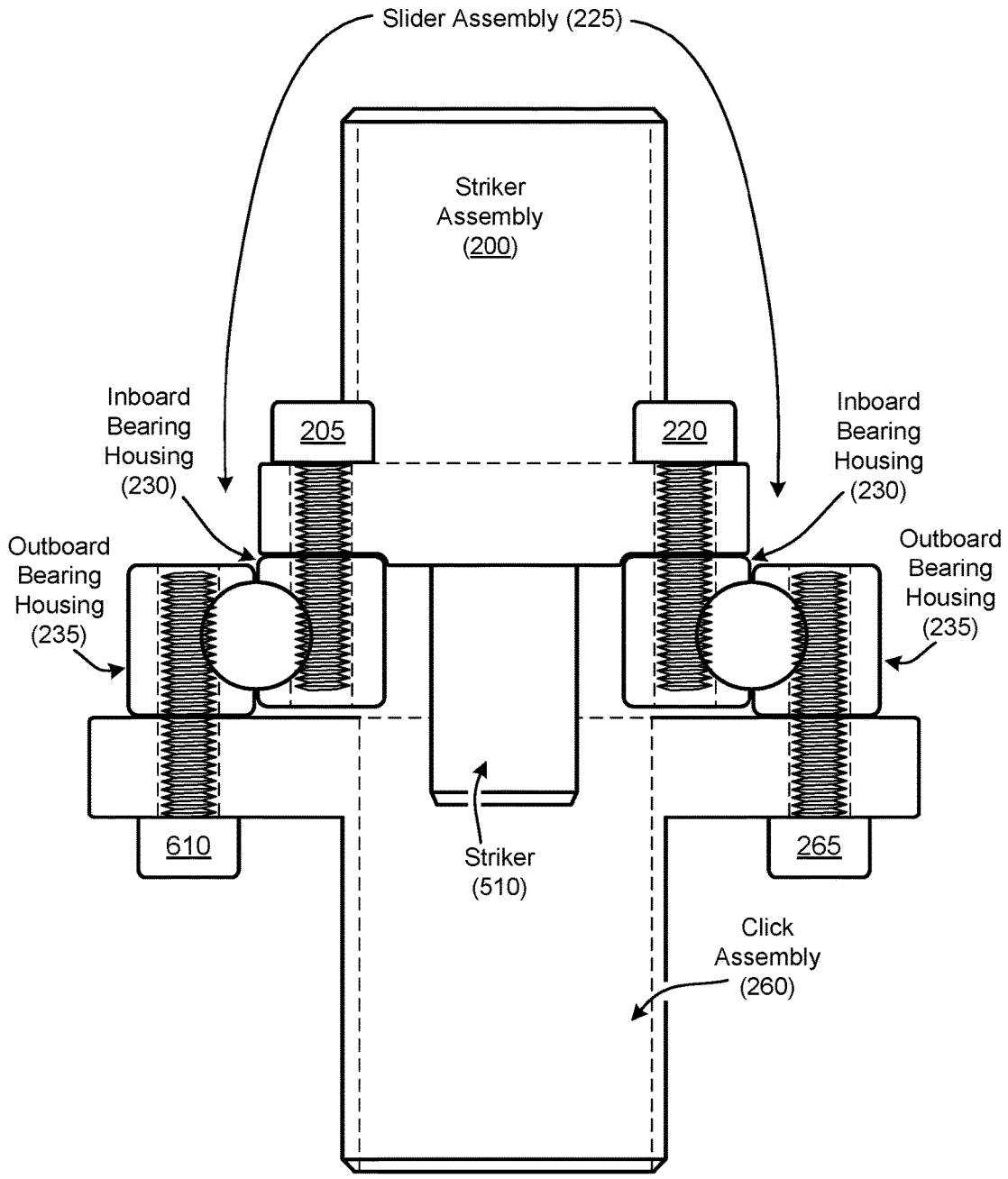
FIG. 12 is a diagram illustrating a partially transparent front side view of an exemplary implementation of the transverse slide mechanism of the Swing Trainer, as described herein.

In general, the transverse shift of the slider assembly during a swing of a sports-related implement to which the transverse slide mechanism is coupled is enabled via the use of ball bearings, roller bearings, wheels, lubricated bearing surfaces, smooth non-lubricated bearing surfaces, other friction reducing techniques that enables the top surface of the slider assembly to slide or shift transversely relative to the bottom surface of the slider assembly For example, as illustrated by FIG. 12 in various implementations, the striker assembly 200 is coupled to the inboard bearing housing 230 of the striker assembly 225. In turn, click assembly 260 is coupled to the outboard bearing housing 235 of the slider assembly 225. As illustrated, bolts 205 and 610, and bolts 220 and 265 form a barrier that prevents ball bearings (not illustrated) from exiting a channel formed between the inboard bearing housing 230 and the outboard bearing housing 235. The presence of retained ball bearings in this channel between the inboard bearing housing 230 and the outboard bearing housing 235 of the slider assembly serves the purpose of slidably coupling the inboard bearing housing to the outboard bearing housing. As such, the striker 510 of the striker assembly 200 moves within the click assembly 260 to contact one of the striking surfaces (not illustrated) during the transverse shift of the slider assembly 225.

Figure 13:
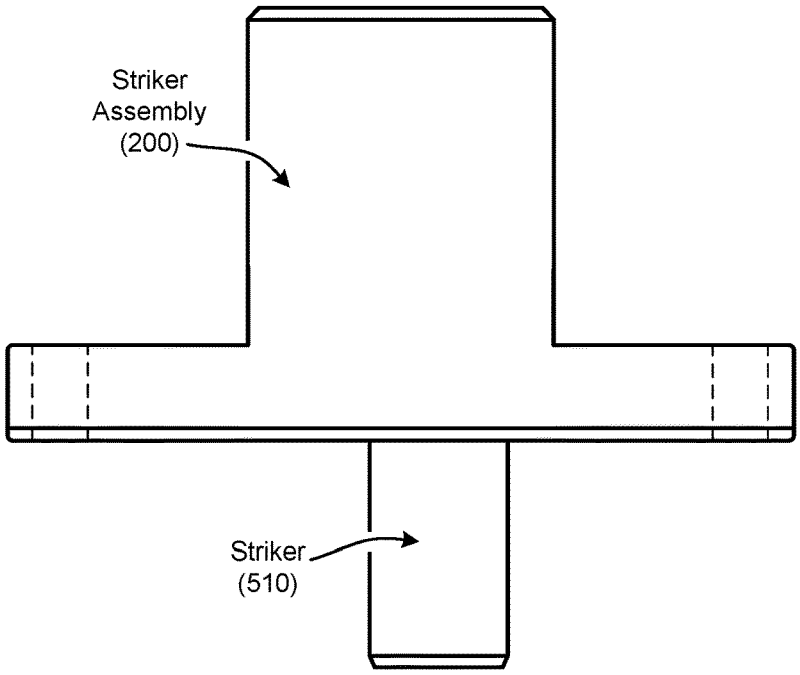
FIG. 13 is a diagram illustrating a partially transparent left side view of a striker assembly of an exemplary implementation of the transverse slide mechanism of the Swing Trainer, as described herein.
Figure 14:
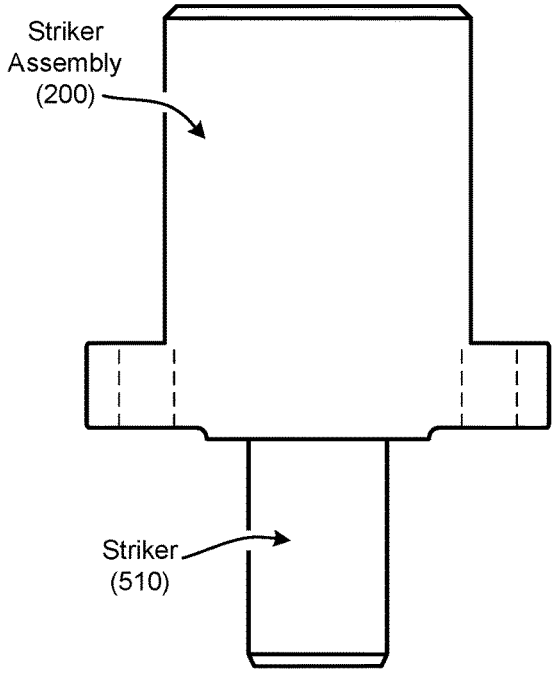
FIG. 14 is a diagram illustrating a partially transparent front side view of the striker assembly of an exemplary implementation of the transverse slide mechanism of the Swing Trainer, as described herein.

As illustrated by FIG. 13 in various implementations, the striker 510 is offset relative to a longitudinal axis of the striker assembly 200. Prior to activation of the transverse slide mechanism, this offset places the striker 510 of the striker assembly 200 in contact one of the striking surfaces (not illustrated) of the click assembly (not illustrated), thereby aligning a longitudinal axis of the striker assembly with a longitudinal axis of the click assembly and preventing further movement or shifting of the striker assembly in the direction of the contacted striking surface. Then, upon the aforementioned transverse shift of the slider assembly (not shown), and the corresponding shift of the striker assembly 200 relative to the click assembly (not shown), the striker 510 contacts the opposing striking surface (not shown) to generate the click. FIG. 14 provides a front side view of the striker assembly 200 and the striker 510.

Figure 15:
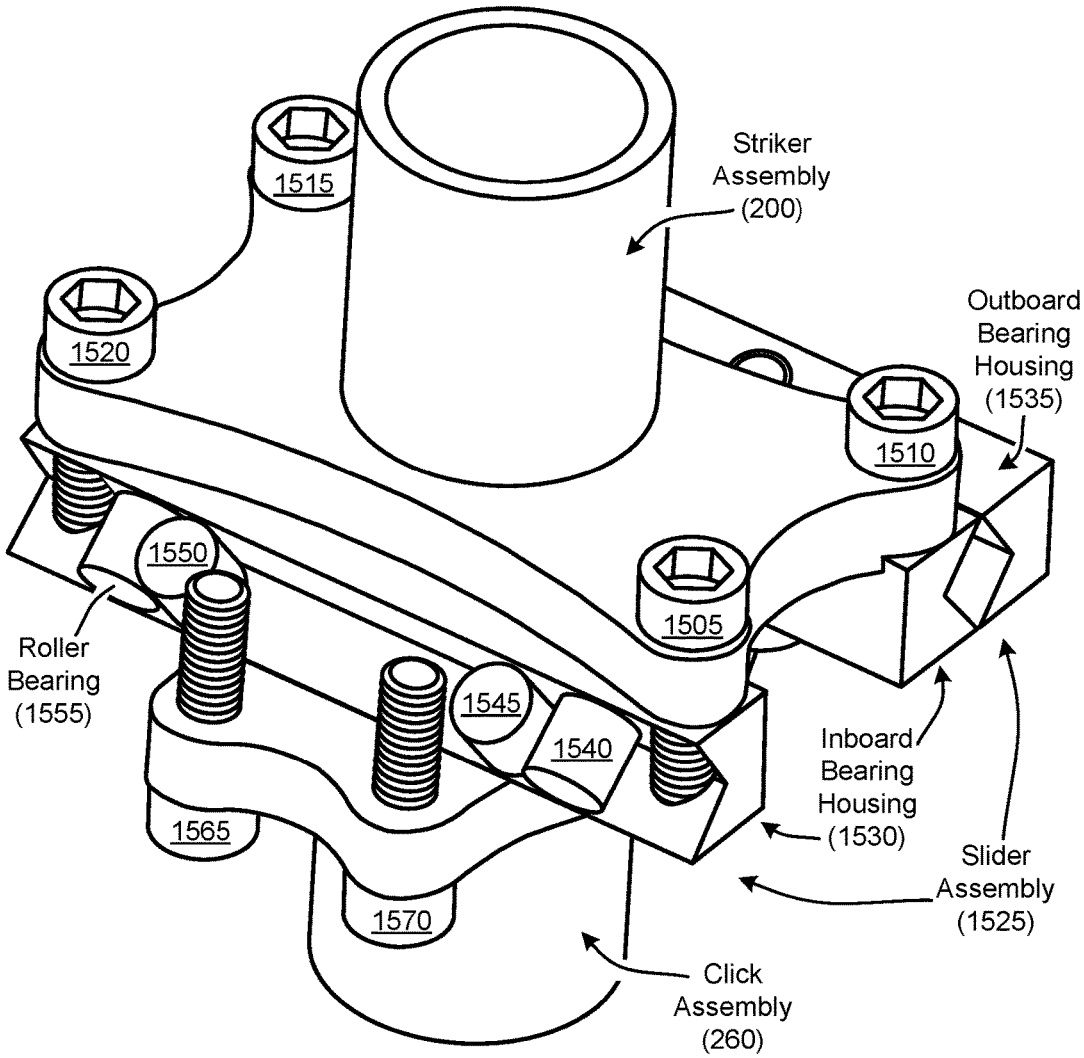
FIG. 15 is a diagram illustrating a partial perspective view of another exemplary implementation of the transverse slide mechanism of the Swing Trainer, as described herein.

Similar to FIG. 2, FIG. 15 illustrates a partial perspective view of an exemplary implementation of the transverse slide mechanism of the Swing Trainer. As illustrated, this exemplary implementation of the transverse slide mechanism includes a striker assembly 200 that is bolted (e.g., 1505, 1510, 1515, 1520) or otherwise coupled to a slider assembly 1525. In various implementations, the slider assembly 225 comprises an inboard bearing housing 1530 or the like in combination with an outboard bearing housing 1535. As further illustrated, the striker assembly 200 is bolted or otherwise coupled to the inboard bearing housing 1530 portion of the slider assembly 1525.

For purposes of illustration, a portion of the outboard bearing housing 1535 is omitted from the foreground of FIG. 15. In contrast to FIG. 2, FIG. 15 illustrates a plurality of roller bearings (e.g., 1540, 1545, 1550 and 1555) instead of the ball bearings illustrated in FIG. 2. In the exemplary implementation of FIG. 15, the click assembly 260 is bolted (e.g., 1565 and 1570, with corresponding bolts not visible in the background of FIG. 15) or otherwise coupled to the slider assembly 1525. As illustrated, the click assembly 260 is bolted or otherwise coupled to the outboard bearing housing 1535 portion of the slider assembly 225. Alternately, the striker assembly 200 may be bolted or otherwise coupled to the outboard bearing housing 1535 portion of the slider assembly 225, while the click assembly 260 is in turn bolted or otherwise coupled to the inboard bearing housing 1530 portion of the slider assembly 225. In either case, the bolts (e.g., 1505, 1510, 1515, 1520, 1565 and 1570, with corresponding bolts not visible in the background of FIG. 15) also ensure that the plurality of roller bearings (e.g., 1540, 1545, 1550 and 1555) are retained within the slider assembly 1525, thereby slidably coupling the striker assembly 200 to the click assembly 260 via the slider assembly 1525.

2.3.7 Curved Slider Assembly of the Transverse Slide Mechanism:

As mentioned, the Swing Trainer provides a mechanism that generates either or both an audible and/or a haptic click in response to a smoothness of a swing of a sports-related implement. With respect to this concept of smoothness, in various implementations, the slider assembly of the transverse slide mechanism includes curved inboard and outboard bearing housings. In other words, rather than using a straight slider mechanism, various implementations of the Swing Trainer use a curved slider assembly. The use of curved bearing housings ensures that the swing trainer will not activate (e.g., click) during a swing unless that swing is relatively less smooth than a similar swing using straight bearing housings (e.g., see FIG. 5 and FIG. 6 for an example of straight bearing housings). Advantageously, the use of curved bearing housings reduces a sensitivity of the transverse slide mechanism to non-smooth swings, thereby permitting novice users to swing the sports-related implement without activating the swing trainer unless the swing is relatively unsmooth. As the user becomes more skilled at swinging the sports-related implement, that user can then switch to a Swing Trainer with straight bearing housings having a higher sensitivity to unsmooth swings (e.g., activating in response relatively smoother swings than with the use of curved bearing housings).

Figure 16:
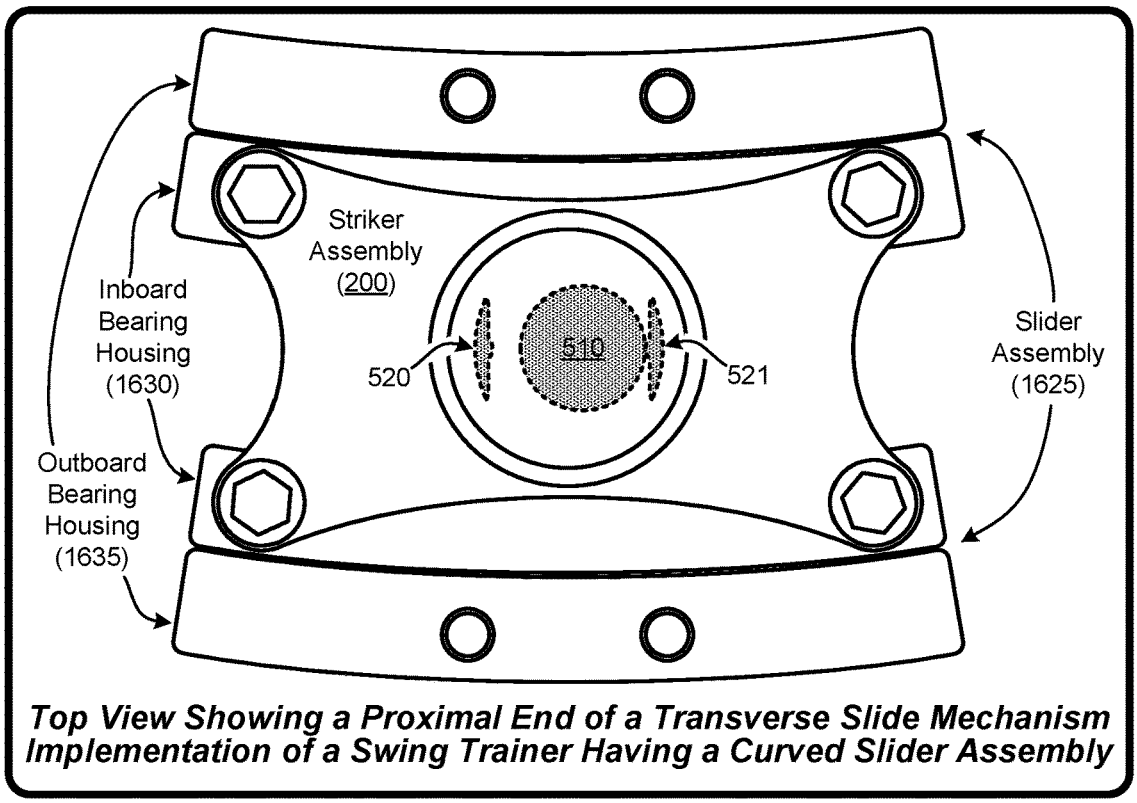
FIG. 16 is a diagram illustrating a top view showing a proximal end of a transverse slide mechanism of an exemplary implementation of a Swing Trainer having a curved slider assembly, as described herein.
Figure 17:
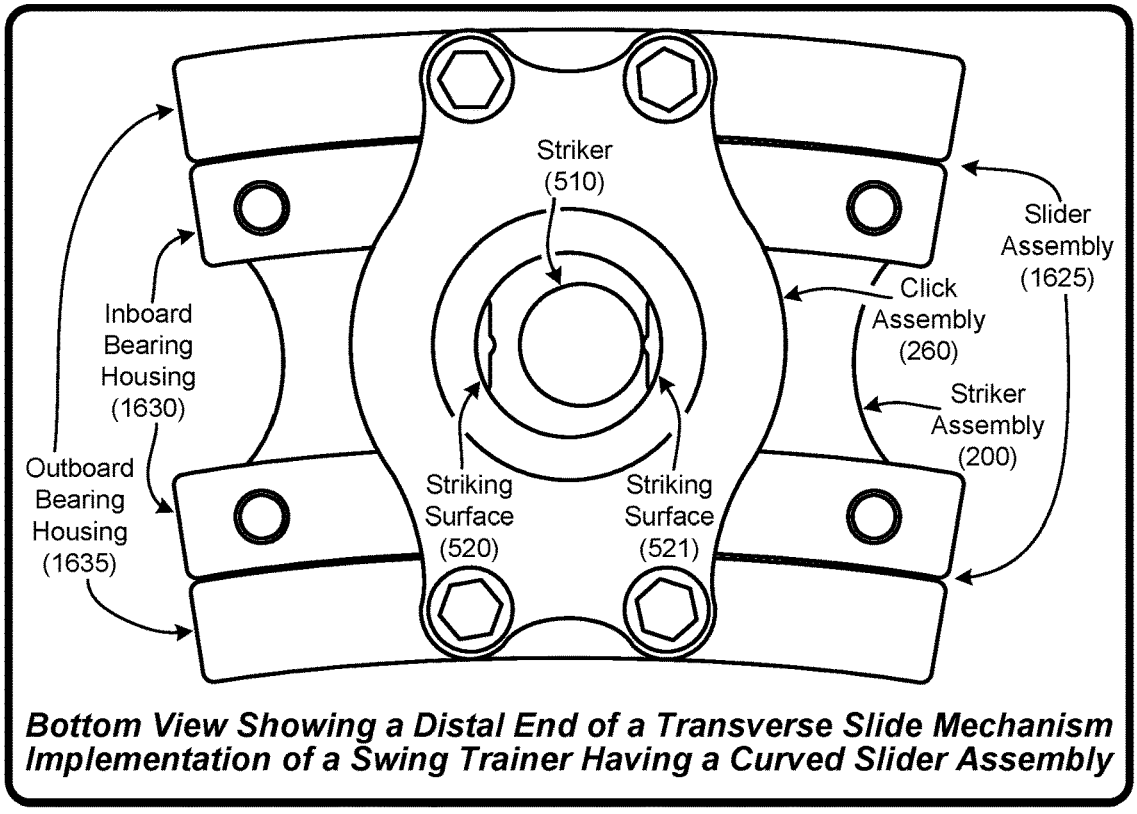
FIG. 17 is a diagram illustrating a bottom view showing a distal end of the transverse slide mechanism of FIG. 16, as described herein.

For example, FIG. 16 shows a partially transparent top view of the transverse slide mechanism that illustrates a proximal end (e.g., a top view) of the transverse slide mechanism. More specifically, similar to FIG. 5, as illustrated by FIG. 16, the striker assembly 200 is bolted or otherwise coupled to a curved inboard bearing housing 1630 of a curved slider assembly 1625. In addition, FIG. 17 provides a bottom view showing a distal end of the transverse slide mechanism of FIG. 16. More specifically, similar to FIG. 6, as illustrated by FIG. 17, the click assembly 260 is bolted to a curved outboard bearing housing 1635 of the curved slider assembly 1625. As with the straight version of the slider assembly (e.g., see element 225 of FIG. 5 and FIG. 6), the curved slider assembly 1625 is capable of shifting transversely, thereby causing both a click and a longitudinal axis offset between the striker assembly 200 and the click assembly 260. However, in contrast to the straight implementation of the slider assembly, the curved implementation of the slider assembly will not activate unless the swing of the sports-related implement is relatively less smooth than the swing needed to activate the straight implementation of the slider assembly.

2.4 Rotational Coupling between the Transverse Slide Mechanism and a Sports-Related Implement:

As mentioned, the transverse slide mechanism is rotatably coupled between the proximal and distal portions of a sports-related implement inline with the longitudinal axis of that sports-related implement. In various implementations, either or both the proximal and distal ends of the transverse slide mechanism include a rotational coupling to the respective proximal and distal portions of the sports-related implement.

Various non-symmetric sports-related implements, e.g., golf clubs, often include a grip having alignment indicators, such as, for example, a flat area, ridges, or other tactile or visible alignment indicators or marks approximately perpendicular to a face or head of the golf club. Such indicators enable the user to hold or grip the sports-related implement in a proper rotational position relative to a swing axis of that sports-related implement. For example, as is well known to those skilled in the art, golf clubs often include alignment indicators or marks as a guide to assist golfers in properly holding the golf club relative to a swing axis of the golf club. In other words, when a golfer is properly holding the golf club, these alignment indicators or marks are in a desired position relative to the swing axis of the golf club. As such, when rotation of the sports-related implement relative to the swing axis of that sports-related implement is of concern, in various implementations, the proximal and distal ends of the transverse slide mechanism each include rotational couplings to the respective proximal and distal portions of the sports-related implement.

More specifically, in the case of non-symmetric sports-related implements, e.g., a golf club having a flat or otherwise indexed grip to align user grip with the club head, both the proximal and distal ends of the transverse slide mechanism include a rotational coupling to the respective sections of the golf club. In this case, the rotational couplings on the proximal and distal ends of the transverse slide mechanism can rotate separately. For example, a rotation of the coupling on the proximal end of the transverse slide mechanism can be paired with an approximately equal rotation of the coupling on the distal end of the transverse slide mechanism. Advantageously, these approximately equal rotations serve to maintain the alignment of the flat or indexed side of the grip with the club head, while concurrently adjusting the static holding force of the transverse slide mechanism relative to the angle of adjustment.

Figure 18:
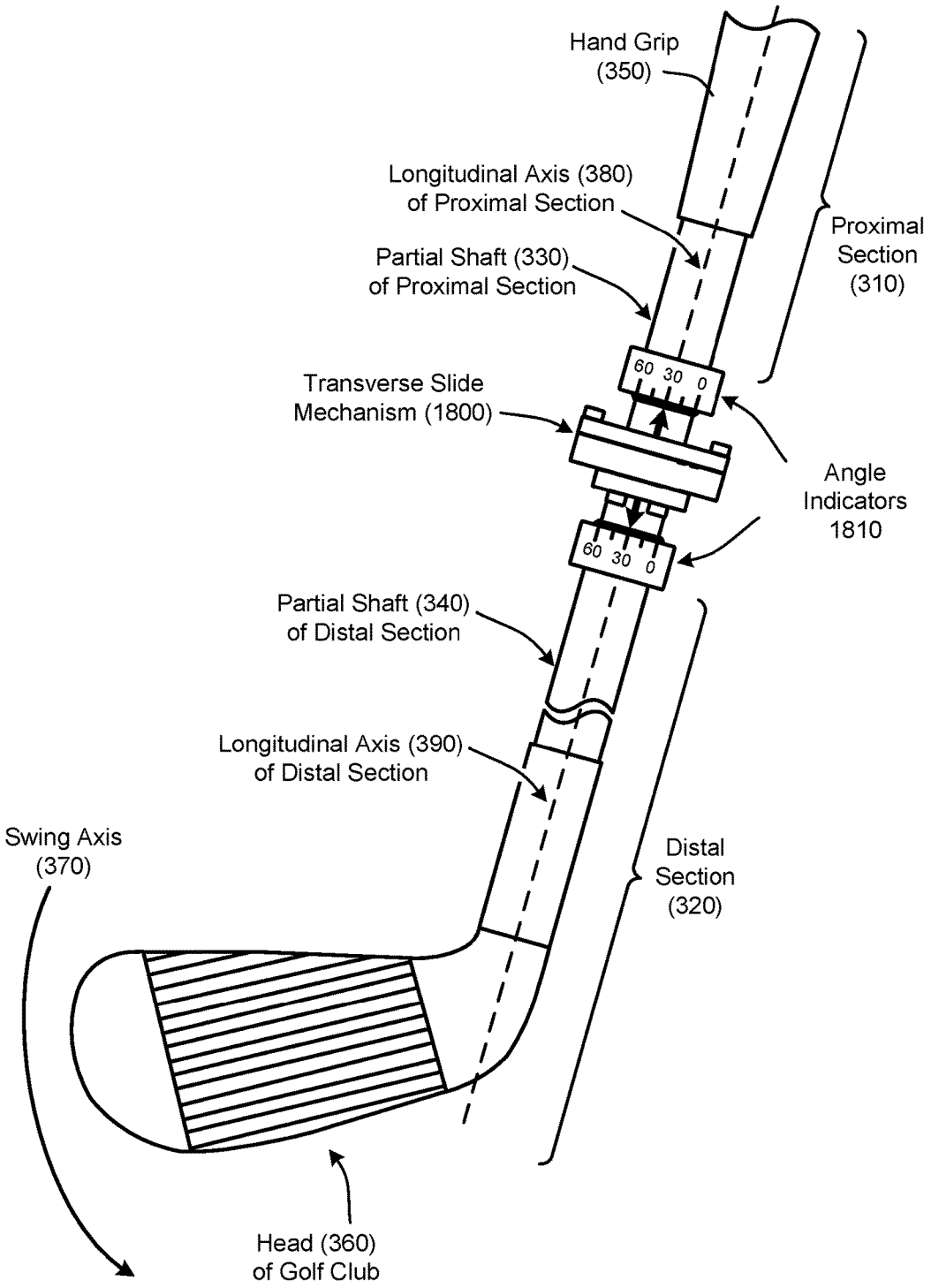
FIG. 18 is a diagram illustrating a partial side view, in simplified form, of another exemplary implementation of the transverse slide mechanism with angle indicators, the transverse slide mechanism coupled to, and connecting, a distal section of a golf club comprising a club head coupled to a partial shaft and a proximal section of the golf club comprising a grip coupled to a partial shaft, as described herein.

For example, similar to FIG. 3, FIG. 18 illustrates a partial side view, in simplified form, of an exemplary implementation of the transverse slide mechanism 1800 rotatably coupled to, and connecting, the proximal section 310 of the golf club to the distal section 320 of the golf club. As illustrated by FIG. 18, the proximal section 310 of the golf club includes the first partial shaft 330 that is rotatably coupled to the transverse slide mechanism 1800. Similarly, as illustrated, the distal section of the golf club includes the second partial shaft 340 that is rotatably coupled to the transverse slide mechanism 1800. As further illustrated by FIG. 18, as with a typical golf club, the proximal section 310 of the golf club includes a hand grip 350 or the like. Further, as with a typical golf club, the distal section 320 of the golf club includes a head 360 or the like for striking golf balls when the golf club is swung along swing axis 370. As illustrated, prior to activation of the transverse slide mechanism 1800 during a swing of the golf club, a first longitudinal axis 380 of the proximal section 310 is in substantial alignment with a second longitudinal axis of the distal section 320. In response to a swing of the golf club, the transverse slide mechanism 1800 may activate (e.g., slide or shift transversely), thereby generating the aforementioned click, and causing the first longitudinal axis 380 of the proximal section 310 to be out of alignment (not shown in FIG. 18) with the second longitudinal axis of the distal section 320.

Further, in the exemplary implementation illustrated by FIG. 18, both of the couplings between the transverse slide mechanism 1800 and the first and second partial shafts (330 and 340) are rotatable couplings. Additionally, in this exemplary implementation, both of these rotatable couplings include angle indicators 1810 that facilitate approximately equal rotations of the rotatable couplings on the proximal and distal ends of the transverse slide mechanism. As mentioned, such approximately equal rotations serve to maintain the alignment of the flat or indexed side of the grip with the club head, while concurrently adjusting the static holding force of the transverse slide mechanism relative to the angle of adjustment.

As mentioned, rotating the transverse slide mechanism away from a swing axis of the sports-related implement decreases the sliding force applied to overcome the static holding force of the transverse slide mechanism. Conversely, rotating the transverse slide mechanism towards the swing axis of the sports-related implement increases the sliding force applied to overcome the static holding force of the transverse slide mechanism. In various implementations, the highest amount of sliding force is applied to the transverse slide mechanism during a swing when that transverse slide mechanism is rotated such that it slides or shifts inline with the swing axis of the sports-related implement. In other words, the highest sliding force occurs at a zero-degree rotation of the transverse slide mechanism relative to the swing axis of the sports-related implement. Conversely, the lowest sliding force occurs at a ninety-degree rotation of the transverse slide mechanism relative to the swing axis of the sports-related implement.

For example, with respect to use of the Swing Trainer with a golf club (e.g., FIG. 3 and FIG. 18), rotational adjustments of the transverse slide mechanism advantageously enables users to select different levels of "slidiness" (e.g., different levels of the static holding force of the transverse slide mechanism) according to the factors such as, for example, length of putts, type of golf club, weight of golf club (and/or head of the golf club), overall length of the golf club with coupled transverse slide mechanism, position of the transverse slide mechanism along the axial length of the golf club, etc.).

Advantageously, adjusting the static holding force of the transverse slide mechanism may assist the user to effectively learn and achieve smooth putting stroke skills, thereby enabling the user to attain consistent directional and distance results when golfing. For example, for relatively short putts (e.g., relatively low swing force), the transverse slide mechanism may be rotated to approximately zero degrees (e.g., lowest static holding force) in which a sliding angle of the transverse slide mechanism is approximately parallel to the swing axis of the golf club to ensure that the transverse slide mechanism activates (e.g., clicks) when the swing or stroke is not smooth. Conversely, for relatively long putts (e.g., relatively high swing force), the transverse slide mechanism may be rotated away from zero degrees (e.g., lowest static holding force) to a larger rotational angle (e.g., ninety degrees in which the sliding angle of the transverse slide mechanism is approximately perpendicular to the swing axis of the golf club) to ensure that the transverse slide mechanism activates (e.g., clicks) when the swing or stroke is not smooth.

In various implementations, rotation of the transverse slide mechanism relative to the proximal and/or distal ends of the sports-related implement may be free, relatively tight, adjustable and/or fixed. In other words, in various implementations, rotational force needed to rotate the transverse slide mechanism prior to swinging the sports-related implement may be free (e.g., relatively low-friction rotational couplings), relatively tight (e.g., relatively high-friction rotational couplings), or adjustable (e.g., adjustable-friction rotational couplings or the like). In various implementations, these rotational couplings include any combination of features such as, for example, gear-based rotational couplings, rotational couplings with tightenable knobs or screws to lock or otherwise increase or decrease rotational force needed to rotate the transverse slide mechanism relative to the sports-related implement, ratchet and pawl-based mechanisms that enable the rotational couplings to be locked into fixed angular rotations based on angular tooth spacing of the ratchet, spring-loaded interlocking star ratchets that enable the rotational couplings to be locked into fixed angular rotations based on angular tooth spacing of the star ratchets, etc.

3.0 Operational Summary of the Swing Trainer:

The systems, devices, and/or processes described above with respect to FIG. 2 through FIG. 18 and in further view of the detailed description provided above in Sections 1 and 2, are summarized by the following paragraphs. In particular, the following paragraphs describe exemplary implementations of the structure and/or operation of some of the various features and instantiations of the Swing Trainer. Further, the following paragraphs are not intended to provide an exhaustive representation of all of the various implementations of the Swing Trainer described herein, and the implementations represented and/or described in the following paragraphs are provided only for purposes of explanation. In addition, any or all of the implementations represented and/or described with respect to the following paragraphs may be used in combination with, or as an alternative to, other implementations that are described throughout this document.

For example, in one implementation, the Swing Trainer is instantiated as a swing training device. This swing training device generally comprises a sports-related implement having a proximal section for gripping the sports-related implement. In addition, the sports-related implement includes a distal section for contacting a sports-related object (e.g., golf ball, baseball, hockey puck, etc.). Further, the swing training device includes a transverse slide mechanism rotatably coupled to and connecting shafts comprising a longitudinal axis of each of the proximal section and the distal section of the sports-related implement. Additionally, in this exemplary implementation, the transverse slide mechanism is configured to generate a click during a swing of the sports-related implement when a sliding force imparted to the transverse slide mechanism by the swing exceeds a static holding force (e.g., friction or other force) of the transverse slide mechanism. Finally, in this exemplary implementation, the transverse slide mechanism is further configured to rotate relative to a swing axis of the sports-related implement. Advantageously, any rotation of the transverse slide mechanism away from the swing axis of the sports-related implement adjusts the transverse slide mechanism by generating a corresponding decrease in the sliding force during a swing of the sports-related implement.

Similarly, in another implementation, the Swing Trainer is instantiated as a golf club. In general, this golf club comprises a hand grip on a proximal section of the golf club. In addition, this golf club further comprises a head on a distal section of the golf club. In this exemplary implementation, a proximal end of a transverse slide mechanism is coupled to a first shaft comprising a longitudinal axis of the proximal section the golf club. Further, in this exemplary implementation, a distal end of the transverse slide mechanism is coupled to a second shaft comprising a longitudinal axis of the distal section of the golf club. In this exemplary implementation, the transverse slide mechanism of the golf club forms an axial coupling between the longitudinal axis of the proximal section the golf club and the longitudinal axis of the distal section of the golf club. In this exemplary implementation, the transverse slide mechanism is configured to generate a click during a swing of the golf club when a sliding force imparted to the transverse slide mechanism by the swing exceeds a static holding force of the transverse slide mechanism. Further, in this exemplary implementation, a striker assembly of the transverse slide mechanism includes oversize bolt holes for coupling to threaded bolt holes of an inboard bearing housing of the transverse slide mechanism. Finally, in this exemplary implementation, a click assembly of the transverse slide mechanism includes oversize bolt holes for coupling to threaded bolt holes of an outboard bearing housing of the transverse slide mechanism. Advantageously, the use of oversize bolt holes in the striker assembly causes an automatic alignment between the bolt holes of the striker assembly and the bolt holes of the inboard bearing housing during assembly of those components (e.g., when bolting those two components together).

In this exemplary implementation, the transverse slide mechanism is configured to generate a click during a swing of the golf club when a sliding force imparted to the transverse slide mechanism by the swing exceeds a static holding force of the transverse slide mechanism. Finally, in this exemplary implementation, the transverse slide mechanism is configured to axially rotate relative to a swing axis of the golf club. Advantageously, any rotation of the transverse slide mechanism away from the swing axis of the golf club adjusts the transverse slide mechanism by generating a corresponding decrease in the sliding force during the swing of the golf club.

In yet another implementation, the Swing Trainer is implemented in the form of a transverse slide mechanism configured for coupling to a sports-related implement. More specifically, in this exemplary implementation, a proximal end of the transverse slide mechanism is configured for rotatable coupling to a proximal section the sports-related implement. Similarly, in this exemplary implementation, a distal end of the transverse slide mechanism is configured for rotatable coupling to a distal section of the sports-related implement. As such, when coupled to both the proximal and distal sections of the sports-related implement, the transverse slide mechanism forms an axially rotatable coupling between the proximal section of the sports-related implement and the distal section of the sports-related implement. Further, when coupled to both the proximal and distal sections of the sports-related implement, the transverse slide mechanism is configured to generate a click during a swing of the sports-related implement when a sliding force imparted to the transverse slide mechanism by the swing exceeds a static holding force of the transverse slide mechanism. Finally, in this exemplary implementation, when coupled to both the proximal and distal sections of the sports-related implement, the transverse slide mechanism is configured to axially rotate relative to a swing axis of the sports-related implement. Advantageously, any rotation of the transverse slide mechanism away from the swing axis of the sports-related implement adjusts the transverse slide mechanism by causing a corresponding decrease in the sliding force during the swing of the sports-related implement.

4.0 Other Implementations:

While the Swing Trainer has been described by specific reference to implementations thereof, it is understood that variations and modifications thereof can be made without departing from the true spirit and intended scope of the Device. By way of example but not limitation, while the foregoing description of the Swing Trainer implementations included certain elements involving sliding mechanisms 9 e.g., the use of ball or roller bearings, lubricated surfaces, etc.), methods for increasing rotational force needed to rotate the transverse relative to the sports-related implement, locking the transverse slide mechanism into particular rotational angles relative to the sports-related implement, etc., it should be recognized that the Swing Trainer implementations are not limited to these specific elements or features.

It is noted that any or all of the implementations that are described in the present document and any or all of the implementations that are illustrated in the accompanying drawings may be used and thus claimed in any combination desired to form additional hybrid implementations. In addition, although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What has been described above includes example implementations. It is, of course, not possible to describe every conceivable combination of components or methodologies for purposes of describing the claimed subject matter, but one of ordinary skill in the art may recognize that many further combinations and permutations are possible. Accordingly, the claimed subject matter is intended to embrace all such alterations, modifications, and variations that fall within the spirit and scope of the appended claims.

The aforementioned implementations have been described with respect to interaction between several components. It will be appreciated that such implementations and components can include those components or specified sub-components, some of the specified components or sub-components, and/or additional components, and according to various permutations and combinations of the foregoing. Sub-components can also be implemented as components coupled to other components rather than included within parent components (e.g., hierarchical components).

Wherefore, what is claimed is:

1. A swing training device, comprising:

a sports-related implement having a proximal section for gripping the sports-related implement;

the sports-related implement having a distal section for contacting a sports-related object;

a transverse slide mechanism rotatably coupled to and connecting shafts comprising a longitudinal axis of each of the proximal section and the distal section of the sports-related implement;

the transverse slide mechanism configured to generate a click during a swing of the sports-related implement when a sliding force that is transverse to the longitudinal axes of the proximal and distal sections of the sports-related implement is imparted to the transverse slide mechanism by the swing and exceeds a static holding force of the transverse slide mechanism; and the transverse slide mechanism configured to rotate about the longitudinal axes of the proximal and distal sections of the sports-related implement relative to a swing axis of the sports-related implement, any rotation of the transverse slide mechanism away from the swing axis of the sports-related implement generating a corresponding decrease in the sliding force during the swing of the sports-related implement.

2. The swing training device of claim 1, the transverse slide mechanism configured to rotate in a first direction relative to the proximal section of the sports-related implement.

3. The swing training device of claim 1, the transverse slide mechanism configured to rotate in a second direction relative to the distal section of the sports-related implement.

4. The swing training device of claim 1, the transverse slide mechanism configured to rotate relative to the proximal section of the sports-related implement and further configured to rotate relative to the distal section of the sports-related implement.

5. The swing training device of claim 1, the sports-related implement comprising:

a golf club;

the distal section of the golf club comprising a club head coupled to a partial shaft;

the proximal section of the golf club comprising a grip coupled to a partial shaft; and the transverse slide mechanism rotatably coupled to and connecting the partial shaft of the distal section of the golf club and the partial shaft of the proximal section of the golf club.

6. The swing training device of claim 5, the grip having a flat surface arranged perpendicularly to a face of the club head.

7. The swing training device of claim 6, the transverse slide mechanism configured to rotate a selectable number of degrees relative to the proximal section of the sports-related implement and further configured to rotate approximately the same selectable number of degrees relative to the distal section of the sports-related implement, thereby maintaining the flat surface of the grip in an approximately perpendicular arrangement with the face of the club head.

8. The swing training device of claim 1, the click being any of an audible click and a haptic click.

9. The swing training device of claim 1, the click generated in response to a lateral shift of a proximal end of the transverse slide mechanism disposed adjacent to the proximal section of the sports-related implement relative to a distal end of the transverse slide mechanism disposed adjacent to the distal section of the sports-related implement during the swing of the sports-related implement when the sliding force exceeds the static holding force.

10. The swing training device of claim 9, the lateral shift of the proximal end of the transverse slide mechanism relative to the distal end of the transverse slide mechanism causing a striker assembly of the transverse slide mechanism to contact an interior face of the transverse slide mechanism, thereby generating the click.

11. The swing training device of claim 9, the lateral shift of the proximal end of the transverse slide mechanism relative to the distal end of the transverse slide mechanism causing a non-intersecting offset between the longitudinal axis of the proximal section of the sports-related implement and the longitudinal axis of the distal section of the sports-related implement.

12. The swing training device of claim 1, further comprising one or more angle indicators to indicate a rotational angle of the transverse slide mechanism relative to any of the proximal section and the distal section of the sports-related implement.

13. The swing training device of claim 1, the transverse slide mechanism further comprising:

a straight inboard bearing housing and a straight outboard bearing housing; and the straight inboard bearing housing and the straight outboard bearing housing configured to jointly retain a plurality of bearings for enabling a lateral shift of a proximal end of the transverse slide mechanism disposed adjacent to the proximal section of the sports-related implement relative to a distal end of the transverse slide mechanism disposed adjacent to the distal section of the sports-related implement during the swing of the sports-related implement when the sliding force exceeds the static holding force.

14. The swing training device of claim 1, the transverse slide mechanism further comprising:

a curved inboard bearing housing and a curved outboard bearing housing; and the curved inboard bearing housing and the curved outboard bearing housing configured to jointly retain a plurality of bearings for enabling a lateral shift of a proximal end of the transverse slide mechanism disposed adjacent to the proximal section of the sports-related implement relative to a distal end of the transverse slide mechanism disposed adjacent to the distal section of the sports-related implement during the swing of the sports-related implement when the sliding force exceeds the static holding force.

15. A golf club, comprising:

a hand grip on a proximal section of the golf club;

a head on a distal section of the golf club;

a transverse slide mechanism comprising a proximal end coupled to a first shaft comprising a longitudinal axis of the proximal section the golf club and a distal end coupled to a second shaft comprising a longitudinal axis of the distal section of the golf club;

the transverse slide mechanism forming an axial coupling between the longitudinal axis of the proximal section the golf club and the longitudinal axis of the distal section of the golf club;

the transverse slide mechanism configured to generate a click during a swing of the golf club when a sliding force imparted to the transverse slide mechanism by the swing exceeds a static holding force of the transverse slide mechanism;

the transverse slide mechanism configured to axially rotate about the longitudinal axes of the proximal and distal sections of the golf club relative to a swing axis of the golf club, any rotation of the transverse slide mechanism away from the swing axis of the golf club generating a corresponding decrease in the sliding force during the swing of the golf club;

a striker assembly of the transverse slide mechanism including oversize bolt holes for coupling to threaded bolt holes of an inboard bearing housing of the transverse slide mechanism; and a click assembly of the transverse slide mechanism including oversize bolt holes for coupling to threaded bolt holes of an outboard bearing housing of the transverse slide mechanism.

16. The golf club of claim 15, the transverse slide mechanism configured to:

rotate relative to the proximal section of the golf club; and further configured to rotate relative to the distal section of the golf club.

17. The golf club of claim 16, further comprising:

a club face disposed on the head of the golf club;

one or more alignment indicators on the hand grip disposed approximately perpendicular to the club face; and wherein rotation of the transverse slide mechanism relative to the proximal section of the golf club in combination with rotation of the transverse slide mechanism relative to the proximal section of the golf club by approximately equal amounts causes the club face to remain approximately perpendicular to the alignment indicators of the hand grip while axially rotating the transverse slide mechanism relative to the swing axis of the golf club.

18. The golf club of claim 16, the transverse slide mechanism further comprising one or more angle indications to indicate an amount of axial rotation of the transverse slide mechanism relative to the any of the proximal section of the golf club and the distal section of the golf club.

19. The golf club of claim 15, wherein:

the click is generated in response to a lateral shift of the proximal end of the transverse slide mechanism relative to the distal end of the transverse slide mechanism during the swing of the golf club when the sliding force exceeds the static holding force; and further wherein the lateral shift causes a striker assembly of the transverse slide mechanism to contact an interior face of the transverse slide mechanism, thereby generating the click.

20. The golf club of claim 15, the transverse slide mechanism further comprising:

a straight inboard bearing housing; and a straight outboard bearing housing.

21. The golf club of claim 15, the transverse slide mechanism further comprising:

a curved inboard bearing housing; and a curved outboard bearing housing.

22. A Swing Trainer, comprising:

a transverse slide mechanism comprising, a proximal end configured for rotatable coupling to a proximal section a sports-related implement, and a distal end configured for rotatable coupling to a distal section of the sports-related implement;

when coupled to both the proximal and distal sections of the sports-related implement, the transverse slide mechanism forming an axially rotatable coupling between the proximal section of the sports-related implement and the distal section of the sports-related implement that allows rotation of the transverse slide mechanism about longitudinal axes of the proximal and distal sections of the golf club;

when coupled to both the proximal and distal sections of the sports-related implement, the transverse slide mechanism configured to generate a click during a swing of the sports-related implement when a sliding force that is transverse to the longitudinal axes of the proximal and distal sections of the sports-related implement is imparted to the transverse slide mechanism by the swing and exceeds a static holding force of the transverse slide mechanism; and when coupled to both the proximal and distal sections of the sports-related implement, the transverse slide mechanism configured to axially rotate relative to a swing axis of the sports-related implement, any rotation of the transverse slide mechanism away from the swing axis of the sports-related implement causing a corresponding decrease in the sliding force during the swing of the sports-related implement.

23. The Swing Trainer of claim 22 further comprising one or more angle indicators to indicate a rotational angle of the transverse slide mechanism relative to any of the proximal section and the distal section of the sports-related implement.

24. The Swing Trainer of claim 22, the transverse slide mechanism further comprising:

a straight inboard bearing housing; and a straight outboard bearing housing.

25. The Swing Trainer of claim 22, the transverse slide mechanism further comprising:

a curved inboard bearing housing; and a curved outboard bearing housing.

* * * * *